US011474458B2

(12) United States Patent
Matsumura et al.

(10) Patent No.: US 11,474,458 B2
(45) Date of Patent: Oct. 18, 2022

(54) IMAGE FORMING APPARATUS THAT DETERMINES WHETHER OR NOT PLURALITY OF ROTATING BODIES ARE IN STATE OF CONTACT

(71) Applicant: CANON KABUSHIKI KAISHA, Tokyo (JP)

(72) Inventors: Ryo Matsumura, Kanagawa (JP); Keisuke Samejima, Shizuoka (JP); Keizo Kojima, Kanagawa (JP); Taro Minobe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/186,240

(22) Filed: Feb. 26, 2021

(65) Prior Publication Data

US 2021/0278786 A1 Sep. 9, 2021

(30) Foreign Application Priority Data

Mar. 6, 2020 (JP) ..... JP2020-039212

(51) Int. Cl.
*G03G 15/16* (2006.01)
*G03G 15/01* (2006.01)

(52) U.S. Cl.
CPC ..... *G03G 15/1675* (2013.01); *G03G 15/0189* (2013.01); *G03G 2215/1614* (2013.01)

(58) Field of Classification Search
CPC ..... G03G 15/1675; G03G 15/0189; G03G 15/1645
See application file for complete search history.

(56) References Cited

U.S. PATENT DOCUMENTS

| | | | | |
|---|---|---|---|---|
| 7,881,634 | B2 * | 2/2011 | Zensai | G03G 21/1821 399/13 |
| 8,165,484 | B2 | 4/2012 | Murayama | |
| 2010/0195150 | A1 * | 8/2010 | Takahashi | G03G 15/5004 358/1.15 |

FOREIGN PATENT DOCUMENTS

| | | | |
|---|---|---|---|
| JP | 2001-083758 | A | 3/2001 |
| JP | 5279224 | B2 | 9/2013 |
| JP | 2014-219620 | A | 11/2014 |
| JP | 2015-011261 | A | 1/2015 |

* cited by examiner

*Primary Examiner* — Arlene Heredia
(74) *Attorney, Agent, or Firm* — Venable LLP

(57) ABSTRACT

A control circuit executes voltage adjustment processing of adjusting a voltage output from a transfer power source so that a current detected by a detection circuit becomes a predetermined current value. The voltage adjustment processing is executed before a toner image is transferred from at least one of a first image bearing member and a second image bearing member to an intermediate transfer belt. A processor determines whether the second transfer member is in a state of contact or is in a state of separation on the basis of behavior of the current detected by the detection circuit in a period in which the control circuit is executing the voltage adjustment processing.

8 Claims, 15 Drawing Sheets

IMAGE FORMING APPARATUS THAT DETERMINES WHETHER OR NOT PLURALITY OF ROTATING BODIES ARE IN STATE OF CONTACT

BACKGROUND OF THE INVENTION

Field of the Invention

The present invention relates to an image forming apparatus that determines whether or not a plurality of rotating bodies are in a state of contact.

Description of the Related Art

An electrophotographic image forming apparatus forms a toner image on a photosensitive drum, transfers the toner image to an intermediate transfer body using a primary transfer member, and furthermore transfers the toner image to a sheet. The former is called "primary transfer", and the latter is called "secondary transfer". In an image forming apparatus that forms full-color images, yellow, magenta, cyan and black toner images are superimposed to form the full-color image. When an image forming apparatus that forms full-color images forms a monochromatic image, the photosensitive drum that handles black images and the primary transfer member are in contact with each other with the intermediate transfer body therebetween, but for the other three colors, the primary transfer member may be separated from the photosensitive drums. This is done to reduce wear on the photosensitive drum, the intermediate transfer body, and the primary transfer member for the other three colors. To determine whether the photosensitive drum and the primary transfer member are in a state of contact or a state of separation, Japanese Patent Laid-Open No. 2001-083758 proposes comparing a current value from when a contact instruction is made and a current value from when a separation instruction is made.

According to the technique of Japanese Patent Laid-Open No. 2001-083758, when a contact/separation determination is started, the image forming apparatus is shifted to the state of contact, and the current is measured, after which the image forming apparatus is shifted to the state of separation, and the current is measured again. It has therefore taken a long time to perform the determination. In particular, if the contact/separation determination is performed at the start of printing, the user will need to wait for a long time, which impairs the usability.

SUMMARY OF THE INVENTION

The present invention provides an image forming apparatus comprising: a first image bearing member that carries a toner image of a first color; a second image bearing member that carries a toner image of a second color; an intermediate transfer belt onto which the toner image carried by at least one of the first image bearing member and the second image bearing member is transferred; a first transfer member that transfers the toner image of the first color from the first image bearing member toward the intermediate transfer belt in a state of contact, the state of contact being a state in which the first transfer member contacts an inner circumferential surface of the intermediate transfer belt and causes an outer circumferential surface of the intermediate transfer belt to contact the first image bearing member; a second transfer member that transfers the toner image of the second color from the second image bearing member toward the intermediate transfer belt in a state of contact, the state of contact being a state in which the second transfer member contacts the inner circumferential surface of the intermediate transfer belt and causes the outer circumferential surface of the intermediate transfer belt to contact the second image bearing member; a contact/separation unit that switches between a state of separation and a state of contact, the state of separation being a state in which the second image bearing member is separated from the outer circumferential surface of the intermediate transfer belt by moving the second transfer member, and the state of contact being a state in which the second image bearing member is caused to contact the outer circumferential surface of the intermediate transfer belt by moving the second transfer member; a transfer power source that outputs a transfer voltage to the first transfer member and the second transfer member; a detection circuit capable of detecting a current flowing in the first transfer member and a current flowing in the second transfer member when the transfer voltage is applied to the first transfer member and the second transfer member; a control circuit that executes voltage adjustment processing of adjusting a voltage output from the transfer power source so that the current detected by the detection circuit becomes a predetermined current value, the control circuit executing the voltage adjustment processing before the toner image is transferred from at least one of the first image bearing member and the second image bearing member to the intermediate transfer belt; and a processor that determines whether the second transfer member is in the state of contact or is in the state of separation on the basis of behavior of the current detected by the detection circuit in a period in which the control circuit is executing the voltage adjustment processing.

Further features of the present invention will become apparent from the following description of exemplary embodiments (with reference to the attached drawings).

DESCRIPTION OF THE EMBODIMENTS

Figure 1:
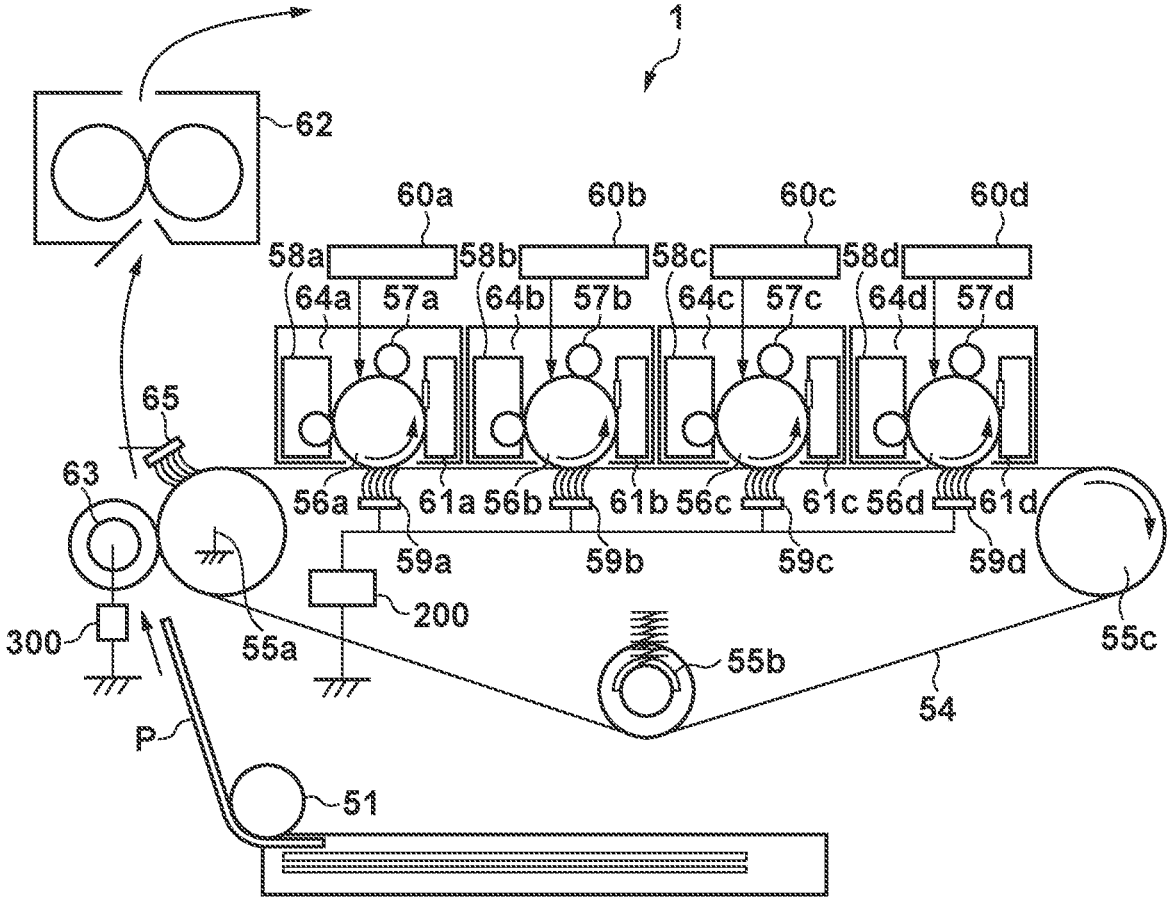
FIG. 1 is a diagram illustrating an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

Image Forming Apparatus

As illustrated in FIG. 1, an image forming apparatus 1 is a printer that uses the electrophotographic technique. The image forming apparatus 1 may be a copier or a facsimile device instead. Image forming stations 64*a* to 64*d* form toner images using Y (yellow), M (magenta), cyan (C), and black (Bk) toners. Note that the a, b, c, and d at the end of the reference signs correspond to Y, M, C, and K, respectively. When describing matters common to all four colors, the a, b, c, and d may be omitted from the reference signs.

The image forming station 64 includes a photosensitive drum 56, a charging roller 57, a developer 58, and a drum cleaner 61. The photosensitive drum 56 rotates in the direction of the arrow at a predetermined rotational speed (process speed). The charging roller 57 uniformly charges the surface of the photosensitive drum 56. An exposure device 60 forms an electrostatic latent image by irradiating the photosensitive drum 56 with light according to an image signal. The developer 58 develops the electrostatic latent image using toner as a developer, and a toner image is formed on the photosensitive drum 56 as a result. A primary transfer member 59 transfers the toner image onto a transfer transport belt 54 using a transfer voltage (primary transfer). Note that a nip area formed by the photosensitive drum 56, the transfer transport belt 54, and the primary transfer member 59 is called a "primary transfer section". A primary transfer power source 200 generates the transfer voltage and supplies the transfer voltage to the primary transfer member 59. The drum cleaner 61 collects the toner remaining on the photosensitive drum 56.

The transfer transport belt 54 is an endless belt. The transfer transport belt 54 is stretched upon tension rollers 55*a*, 55*b*, and 55*c*. The yellow toner image, the magenta toner image, the cyan toner image, and the black toner image are sequentially transferred to and superimposed on the transfer transport belt 54. A full-color image is formed as a result. The transfer transport belt 54 may also be called an "intermediate transfer belt" or an "intermediate transfer body". The transfer transport belt 54 transfers the toner image onto a secondary transfer roller 63 by rotating in the direction indicated by the arrow. A nip area formed by the secondary transfer roller 63 and the transfer transport belt 54 may also be called a "secondary transfer section".

A paper feed roller 51 transports a sheet P to the secondary transfer section so that the timing at which the toner image arrives at the secondary transfer section coincides with the timing at which the sheet arrives at the secondary transfer section. A secondary transfer power source 300 applies a transfer voltage to the secondary transfer roller 63. The secondary transfer roller 63 transfers the toner image from the transfer transport belt 54 to the sheet P using the transfer voltage (secondary transfer). A belt cleaner 65 cleans off toner remaining on the transfer transport belt 54. A fixer 62 fixes the toner image to the sheet P by applying heat and pressure to the sheet P and the toner image that have passed through the secondary transfer section.

Control of Image Forming Apparatus

Figure 2:
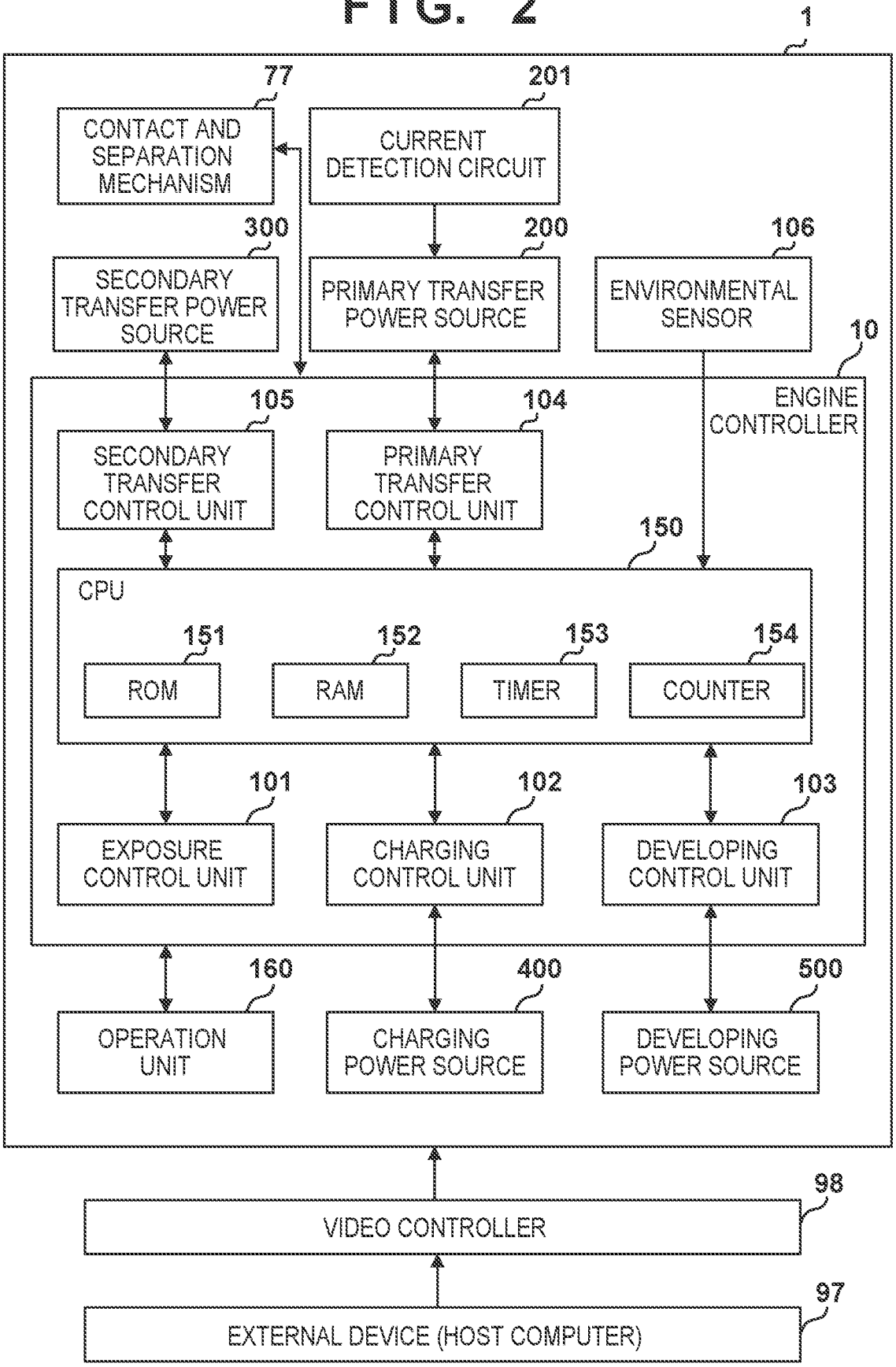
FIG. 2 is a block diagram illustrating a controller.

FIG. 2 illustrates an engine controller 10 that controls the image forming apparatus 1. The engine controller 10 includes a CPU 150. The CPU 150 is connected to, or includes, ROM 151 and RAM 152. The CPU 150 controls an exposure control unit 101, a charging control unit 102, a developing control unit 103, a primary transfer control unit 104, and a secondary transfer control unit 105 in accordance with a control program stored in the ROM 151. The ROM 151 also stores an environmental table, a control table, and the like. An environmental sensor 106 detects the temperature and humidity in an installation environment. The CPU 150 obtains control data by referring to the environmental table on the basis of a result of the detection. The RAM 152 temporarily holds the control data, is used as a work area for computation processing involved in the control, and the like. The charging control unit 102 controls a charging voltage output to the charging roller 57 from a charging power source 400. The developing control unit 103 controls a developing voltage output to the developer 58 from a developing power source 500. The primary transfer control unit 104 controls the primary transfer power source 200 to control a primary transfer voltage output from the primary transfer power source 200 to the primary transfer member 59 on the basis of a current value detected by a current detecting circuit 201. The secondary transfer control unit 105 controls the secondary transfer power source 300 to control a secondary transfer voltage output from the secondary transfer power source 300 to the secondary transfer roller 63.

A video controller 98 generates an image signal by converting image information and a print command received from an external device 97, and outputs the image signal to the engine controller 10. The engine controller 10 outputs the image signal to the exposure control unit 101.

A timer 153 measures a variety of times. A counter 154 counts a number of printed sheets. An operation unit 160 includes an input device that accepts instructions from a user and a display device that displays messages to the user. A contact/separation unit 77 includes an actuator, such as a motor or a solenoid, as well as gears, cams, and the like that move the primary transfer member 59 up and down using the force supplied by the actuator. The contact/separation unit 77 may further include a spring or the like that biases the primary transfer member 59 toward the photosensitive drum 56.

Intermediate Transfer Unit

Figure 3:
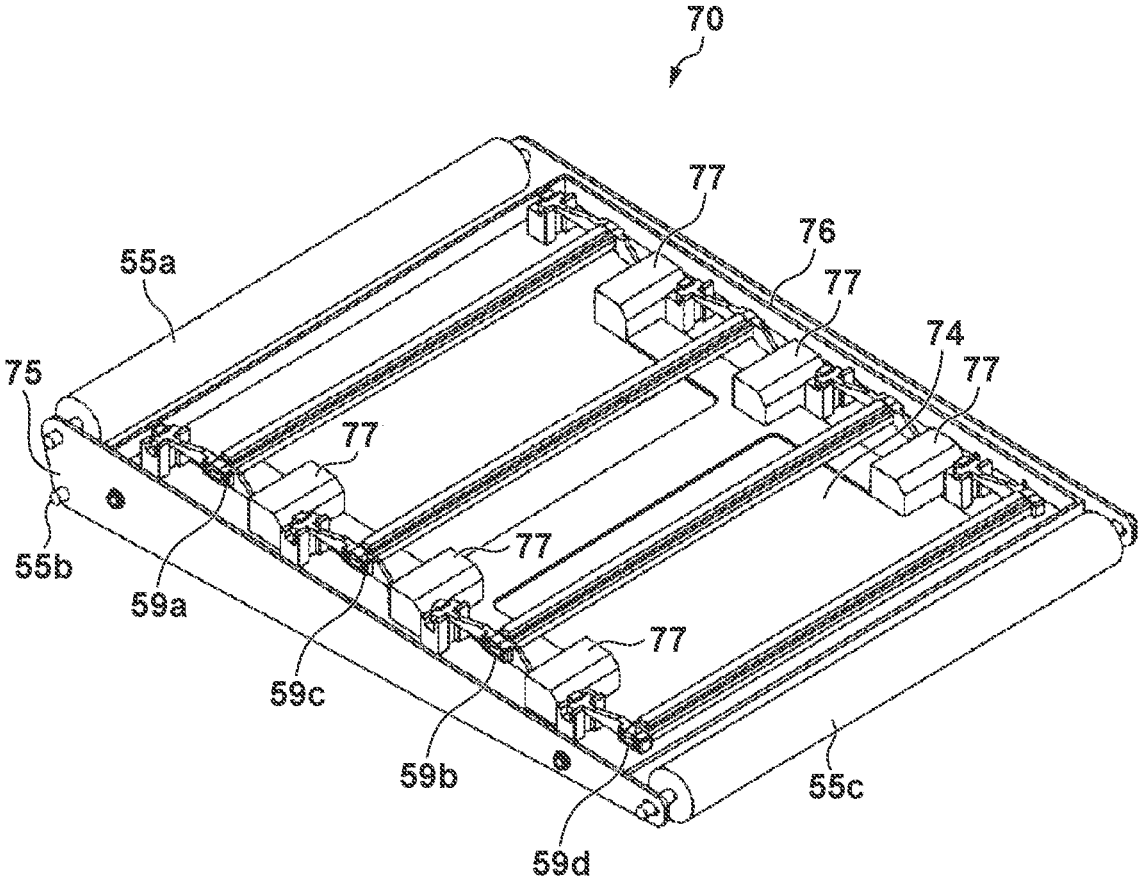
FIG. 3 is a diagram illustrating an intermediate transfer unit.

FIG. 3 illustrates an intermediate transfer unit 70. With respect to the image forming apparatus 1, the right side in FIG. 1 is defined as the "front". The left side in FIG. 1 is defined as the "rear". The near side of the drawing with respect to the viewer of FIG. 1 is defined as the "left". The far side of the drawing with respect to the viewer of FIG. 1 is defined as the "right". With respect to the image forming apparatus 1, the upper side in FIG. 1 is defined as the "top". The lower side in FIG. 1 is defined as the "bottom".

The intermediate transfer unit 70 includes the transfer transport belt 54, the tension rollers 55*a*, 55*b*, and 55*c*, a frame 74, a left side plate 75, a right side plate 76, and the contact/separation unit 77. The transfer transport belt 54 is not illustrated in FIG. 3.

The tension rollers 55*a*, 55*b*, and 55*c* are rotatably supported by the left side plate 75 and the right side plate 76. The left side plate 75 and the right side plate 76 are attached to the frame 74. The tension roller 55*a* is driven and rotated by a drive source (e.g., a motor) provided in the image forming apparatus 1, and rotates the transfer transport belt 54. The tension roller 55*c* is biased from an inner circumferential surface side to an outer circumferential surface side of the transfer transport belt 54 by a tension spring. This imparts tension (belt tension) on the transfer transport belt 54. The tension roller 55*c* may be referred to simply as a "tension roller". The primary transfer members 59*a*, 59*b*, 59*c*, and 59*d* are disposed on the inner circumferential surface side of the transfer transport belt 54, corresponding to the photosensitive drums 56*a*, 56*b*, 56*c*, and 56*d*, respectively. The primary transfer members 59*a*, 59*b*, 59*c*, and 59*d* are supported by the frame 74 via the contact/separation unit (mechanism) 77. The contact/separation unit 77 is a contact/separation mechanism. When the contact/separation unit 77 pushes the primary transfer members 59*a*, 59*b*, 59*c*, and 59*d* upward, the primary transfer members 59*a*, 59*b*, 59*c*, and 59*d* push toward the photosensitive drums 56*a*, 56*b*, 56*c*, and 56*d* over the transfer transport belt 54. The primary transfer nip is formed as a result.

The secondary transfer roller 63 illustrated in FIG. 1 is disposed in a position opposite the tension roller 55*a*, with the transfer transport belt 54 located therebetween. The secondary transfer roller 63 presses the transfer transport belt 54 toward the tension roller 55*a*. A secondary transfer nip is formed between the transfer transport belt 54 and the secondary transfer roller 63 as a result.

The contact/separation unit 77 moves downward in order to separate the transfer transport belt 54 from the photosensitive drums 56*a*, 56*b*, and 56*c*. The contact/separation unit 77 moves upward in order to bring the primary transfer members 59*a*, 59*b*, and 59*c* into contact with the photosensitive drums 56*a*, 56*b*, and 56*c*.

Separation of Primary Transfer Unit

Figure 4A:
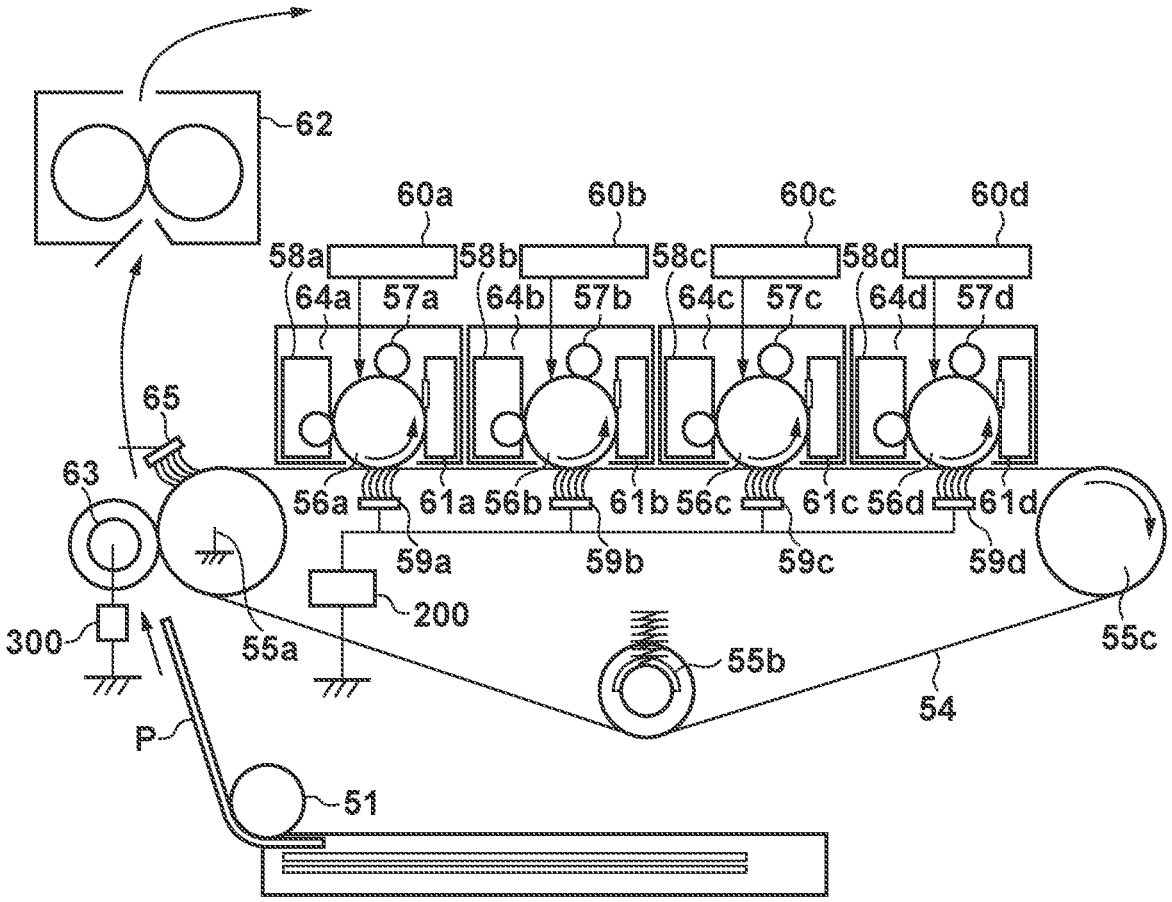
FIGS. 4A and 4B are diagrams illustrating a state of contact and a state of separation.
Figure 4B:
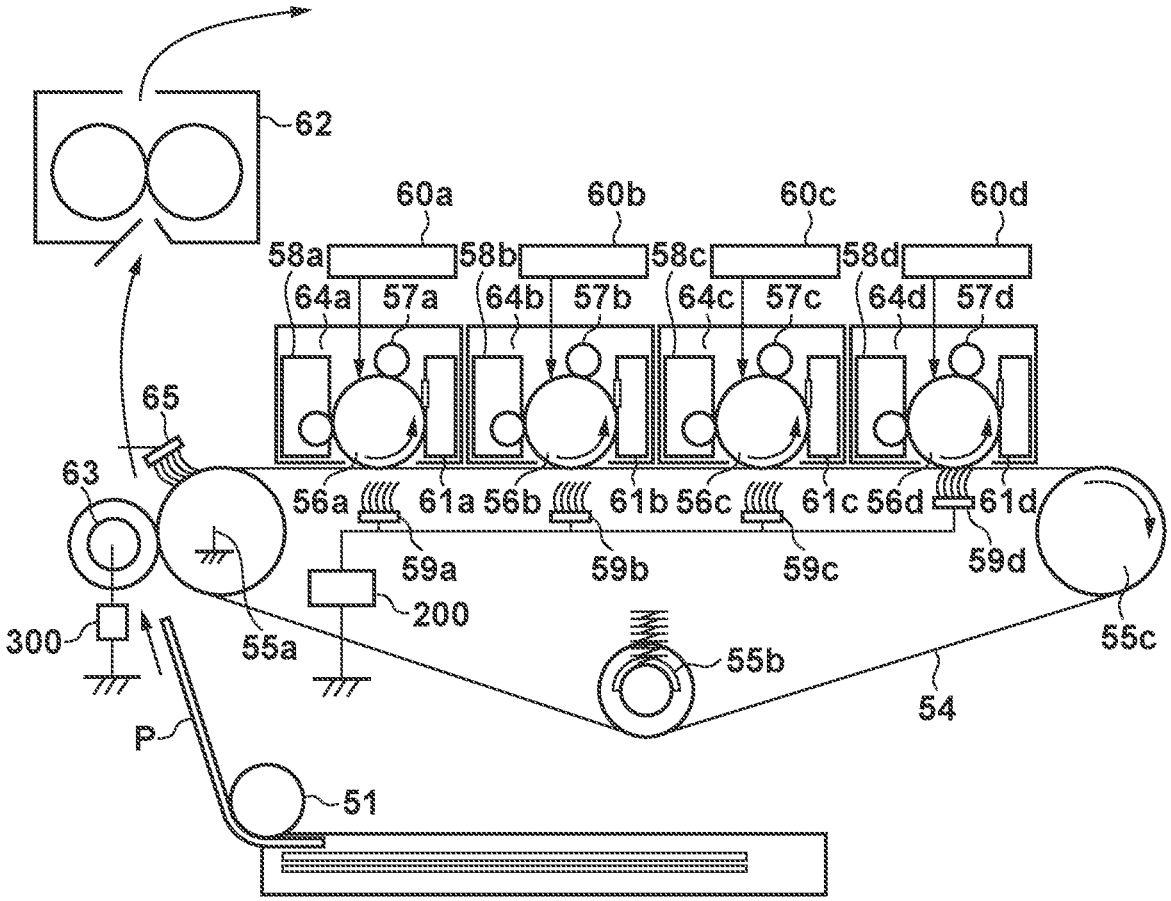

A relationship between the photosensitive drums 56*a*, 56*b*, 56*c*, and 56*d* and the transfer transport belt 54 is switched between the state of contact and the state of separation as a result of the contact/separation unit 77 driving the primary transfer member 59. FIG. 4A illustrates the state of contact/state of separation in color printing. FIG. 4B illustrates the state of contact/state of separation in black printing. As illustrated in FIG. 4A, in color printing, the primary transfer members 59*a*, 59*b*, 59*c*, and 59*d* lift the transfer transport belt 54 against the belt tension by applying a compressive force to the inner circumferential surface of the transfer transport belt 54. The primary transfer members 59*a*, 59*b*, 59*c*, and 59*d* move so as to approach lower surfaces of the corresponding photosensitive drums 56*a*, 56*b*, 56*c*, and 56*d*. As a result, the primary transfer members 59*a*, 59*b*, 59*c*, and 59*d* press against the lower surfaces of the photosensitive drums 56*a*, 56*b*, 56*c*, and 56*d* with a predetermined compressive force. Through this, the primary transfer members 59*a*, 59*b*, 59*c*, and 59*d* form a primary transfer nip between the photosensitive drums 56*a*, 56*b*, 56*c*, and 56*d* and the transfer transport belt 54. The transfer transport belt 54 is sandwiched between the primary transfer members 59*a*, 59*b*, 59*c*, and 59*d* and the photosensitive drums 56*a*, 56*b*, 56*c*, and 56*d*, and the photosensitive drums 56*a*, 56*b*, 56*c*, and 56*d* and the transfer transport belt 54 come into contact with each other. In other words, the primary transfer members 59*a*, 59*b*, 59*c*, and 59*d* contact the photosensitive drums 56*a*, 56*b*, 56*c*, and 56*d* indirectly.

As illustrated in FIG. 4B, in black printing, the primary transfer members 59*a*, 59*b*, and 59*c* move approximately several millimeters in a direction away from the transfer transport belt 54. The primary transfer members 59*a*, 59*b*, and 59*c* separate from the inner circumferential surface of the transfer transport belt 54 as a result.

Current Path

In the first embodiment, the CPU 150 determines whether the primary transfer section (the nip area) is in the state of contact or the state of separation on the basis of a transfer current flowing in the primary transfer member 59.

Color Printing

Figure 5:
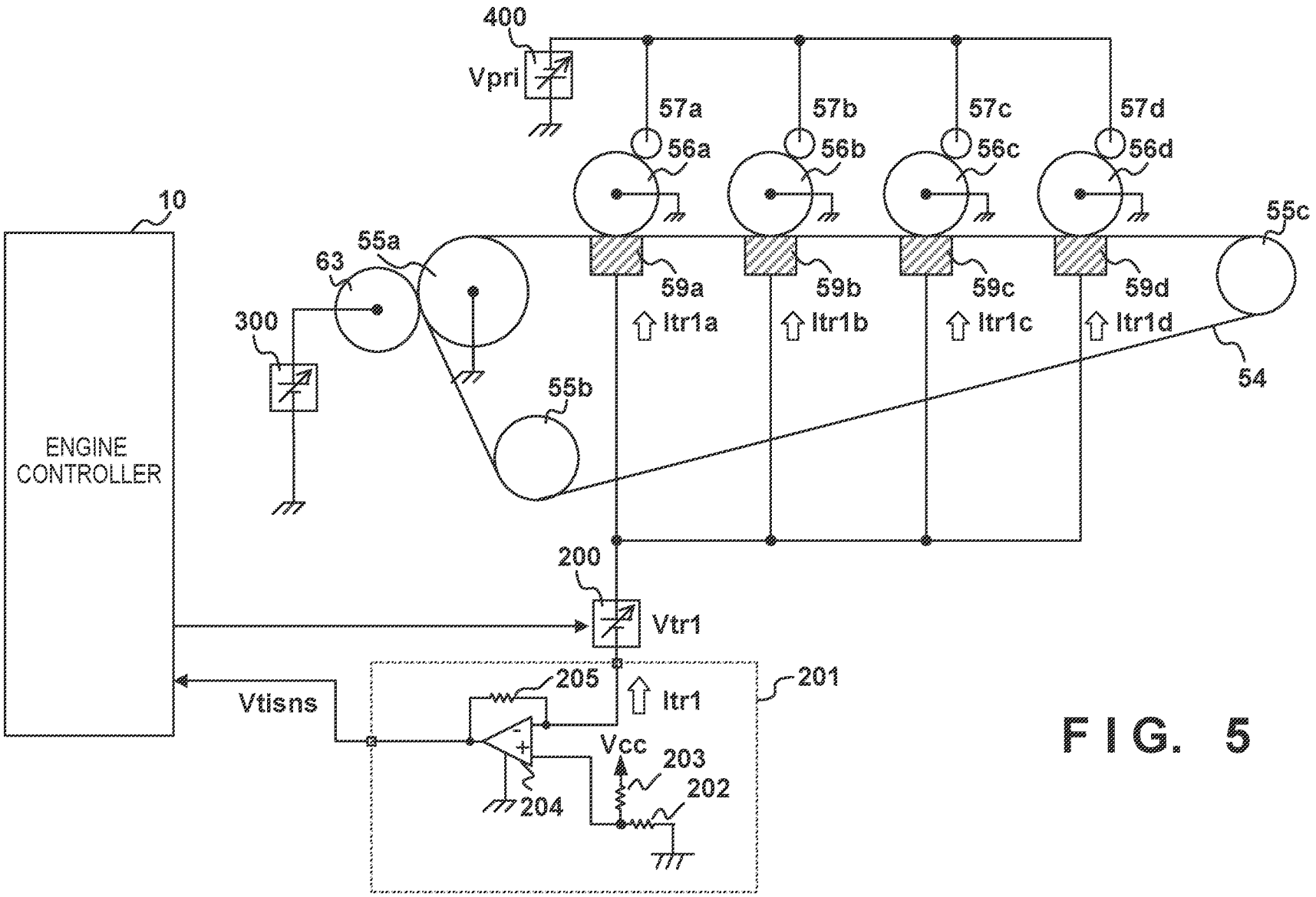
FIG. 5 is a diagram illustrating a path of primary transfer current in color printing.

FIG. 5 is a schematic diagram illustrating the arrangement of the photosensitive drums 56*a*, 56*b*, 56*c*, and 56*d* and the transfer transport belt 54, as well as a path in which the transfer current flows, in color printing. At this time, the contact/separation unit 77 is located at a color contact position. A primary transfer voltage required for image forming is applied to the primary transfer members 59*a*, 59*b*, 59*c*, and 59*d* in common from the primary transfer power source 200. The current detecting circuit 201 detects the primary transfer current flowing in the four primary transfer sections.

The current detecting circuit 201 includes an op-amp 204 and resistors 202, 203, and 205 connected to the primary transfer power source 200. An output of the op-amp 204 (a result of detecting the primary transfer current) is fed back to the engine controller 10. The resistors 202 and 203 form a voltage division circuit that divides a source voltage Vcc to generate a voltage Vt. The voltage Vt is input to a positive input of the op-amp 204. The voltage value of the voltage Vt is set to approximately several volts in consideration of the rating of the op-amp 204. The op-amp 204 constitutes a negative feedback circuit using the resistor 205. As such, a potential difference between the positive input and the negative input of the op-amp 204 is 0 volts. In other words, the positive input and the negative input of the op-amp 204 are at the same potential as the voltage Vt.

When the primary transfer power source 200 begins outputting the primary transfer voltage, the primary transfer voltage is applied to the primary transfer members 59*a*, 59*b*, 59*c*, and 59*d*, and current flows in the primary transfer section. A primary transfer current Itr1*a* flows to GND via the primary transfer member 59*a* and the photosensitive drum 56*a*. A primary transfer current Itr1*b* flows to GND via the primary transfer member 59*b* and the photosensitive drum 56*b*. A primary transfer current Itr1*c* flows to GND via the primary transfer member 59*c* and the photosensitive drum 56*c*. A primary transfer current Itr1*d* flows to GND via the primary transfer member 59*d* and the photosensitive drum 56*d*. Each path in which the current flows is indicated by an arrow. A total current Itr1 is a current obtained by totaling the primary transfer currents Itr1*a*, Itr1*b*, Itr1*c*, and Itr1*d*. The total current Itr1 flows from GND to the op-amp 204. Furthermore, the total current Itr1 returns to the primary transfer power source 200 from an output terminal of the op-amp 204 via the resistor 205. With such a current path, a detection voltage Vtisns correlated with the total current Itr1 arises at both ends of the resistor 205, and becomes the output of the op-amp 204.

$$Itr1=(Vtisns-Vt)/R205 \quad (1)$$

Here, R205 represents the resistance value of the resistor 205. Equation (1) is an equation that associates the voltage value of the voltage Vtisns with the current Itr1 flowing in the primary transfer members 59*a*, 59*b*, 59*c*, and 59*d*. Equation (1) is stored in the ROM 151 in advance. The voltage value of the voltage Vt and the resistance value of the resistor 205 are known, and are coefficients. The CPU 150 can obtain the total current Itr1 by reading out Equation (1) from the ROM 151 and substituting the voltage Vtisns output from the current detecting circuit 201 in Equation (1).

The total current Itr1 is the detection result from the current detecting circuit 201, and may be called a "total primary transfer current".

Black Printing

Figure 6:
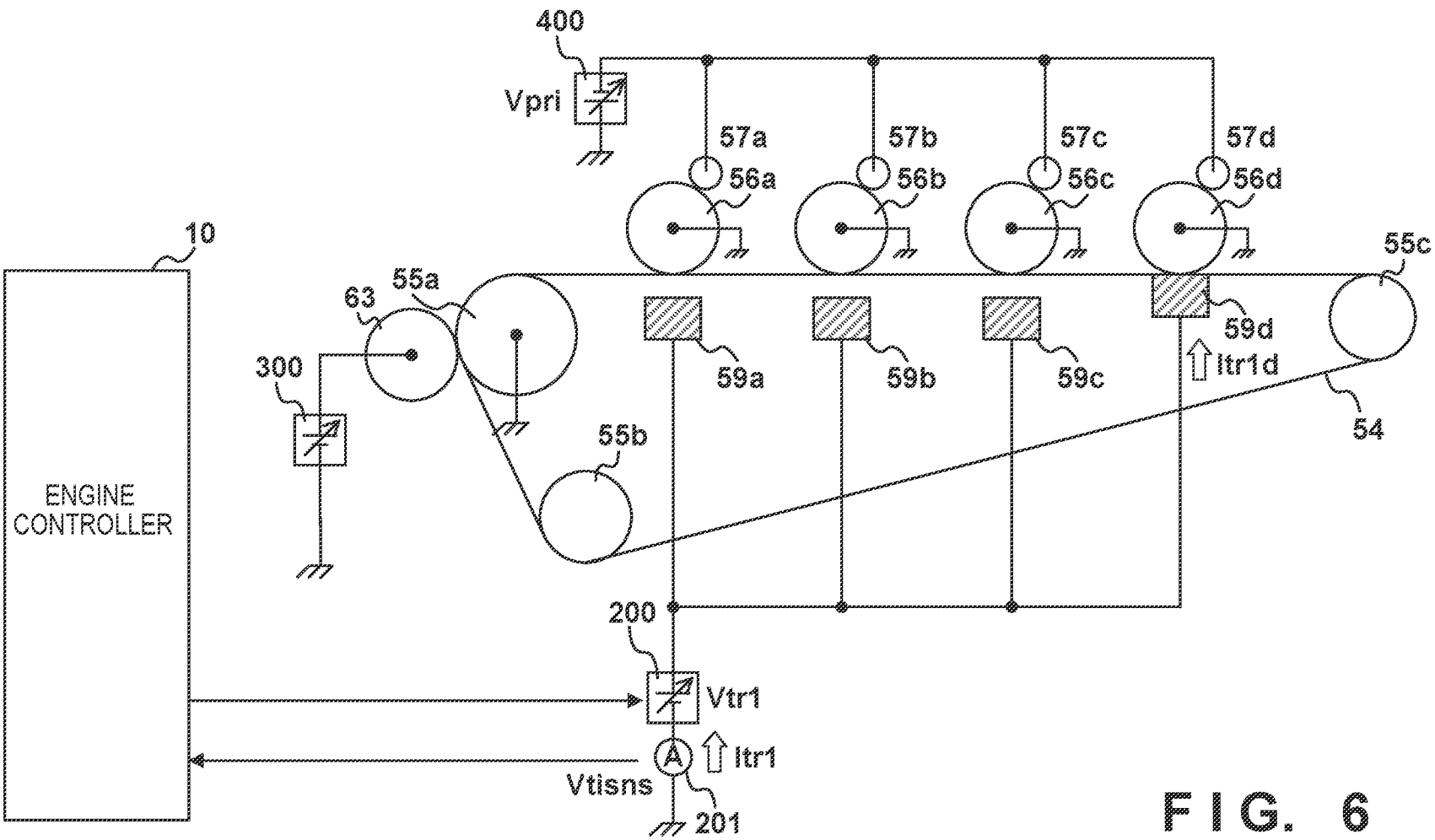
FIG. 6 is a diagram illustrating a path of primary transfer current in black printing.

FIG. 6 is a schematic diagram illustrating the arrangement of the photosensitive drums 56*a*, 56*b*, 56*c*, and 56*d* and the transfer transport belt 54, as well as a path in which the transfer current flows, in black printing. At this time, the contact/separation unit 77 is located at a color separation position. The primary transfer members 59*a*, 59*b*, and 59*c* have moved in a direction away from the transfer transport belt 54 and are therefore separated from the inner circumferential surface of the transfer transport belt 54. The primary transfer member 59*d* that handles black forms the primary transfer nip between the photosensitive drum 56*d* and the transfer transport belt 54.

When the primary transfer power source 200 turns on, voltages are applied to the primary transfer members 59*a*, 59*b*, 59*c*, and 59*d*. As illustrated in FIG. 6, the transfer transport belt 54 and the primary transfer member 59*d* are in contact, and therefore only the current Itr1*d* flows in the primary transfer member 59*d*. On the other hand, no current flows in the primary transfer members 59*a*, 59*b*, and 59*c*. This is because the transfer transport belt 54 and the primary transfer members 59*a*, 59*b*, and 59*c* have been separated from each other by the contact/separation unit 77. The total current Itr1 is therefore equal to the current Itr1*d*. Note that the current Itr1*d* flows to GND via the primary transfer member 59*d* and the photosensitive drum 56*d*. Furthermore, the current Itr1*d* flows from GND to the op-amp 204. The total current Itr1 (the current Itr1*d*) returns to the primary transfer power source 200 from the output terminal of the op-amp 204 via the resistor 205. The CPU 150 obtains the detection result from the current detecting circuit 201 (the detection voltage Vtisns). By substituting the detection voltage Vtisns in Equation (1), the CPU 150 obtains the current Itr1*d* flowing in the primary transfer member 59*d*.

ATVC

The CPU 150 applies an appropriate primary transfer voltage Vtr1 to the primary transfer member 59 during image forming. Processing of adjusting the primary transfer voltage Vtr1 is therefore called "ATVC". "ATVC" is an acronym of "automatic transfer voltage control".

Color Printing

A thermoplastic resin having ionic conductivity, for example, can be used as the material of the transfer transport belt 54. The resistance value of a material having ionic conductivity is susceptible to major fluctuations depending on the temperature, humidity, and so on. In the first embodiment, a primary transfer brush that makes contact with and rubs against the inner circumferential surface of the transfer transport belt 54 may be used as the primary transfer member 59. A tip end of the primary transfer brush that contacts the inner circumferential surface of the transfer transport belt 54 picks up adhering objects (wear debris of the transfer transport belt 54 and the like) produced when the primary transfer brush rubs against the inner circumferential surface of the transfer transport belt 54. Accordingly, the resistance value of the primary transfer brush increases with the number of sheets to be printed (the number of prints performed).

By executing ATVC, the image forming apparatus 1 determines an appropriate primary transfer voltage, even when the environment, durability, and the like of the primary transfer member 59 fluctuate. ATVC is executed before forming images. The CPU 150 obtains information pertaining to the resistance value of the transfer transport belt 54, the resistance values of the primary transfer members 59*a*, 59*b*, 59*c*, and 59*d*, and the like. Specifically, the CPU 150 obtains these resistance values by controlling the primary transfer power source 200 to apply a test voltage to the primary transfer members 59*a*, 59*b*, 59*c*, and 59*d*. On the basis of the result of detecting the resistance value, the CPU 150 determines the appropriate primary transfer current (target current) to be used in the image forming.

The ROM 151 stores a control table that holds a target value for the total current Itr1 corresponding to a combination of environmental conditions (temperature and humidity) and a number of printed sheets. The number of printed sheets is set at zero when the intermediate transfer unit 70 is new. The CPU 150 may count the number of printed sheets using the counter 154. The total current Itr1 is the total current flowing in the primary transfer members 59*a*, 59*b*, 59*c*, and 59*d*. In ATVC, the CPU 150 determines, from the control table, a target value for the total current based on the detection result of the environmental sensor 106 and a count value of the counter 154. In ATVC, the CPU 150 adjusts the output voltage value of the primary transfer power source 200 so that the current detected by the current detecting circuit 201 approaches the target value (constant current control). The CPU 150 controls the output voltage of the primary transfer power source 200 by setting the voltage setting value of the primary transfer power source 200. The voltage setting value and the output voltage are correlated. As such, the CPU 150 can find the output voltage value of the primary transfer power source 200 (which may be an average of the output values in a set period) from the voltage setting value. Alternatively, the CPU 150 includes an AD converter. Accordingly, the CPU 150 may obtain the output voltage value by using the AD converter to A/D convert a divided voltage value of the output voltage from the primary transfer power source 200. The CPU 150 determines the obtained output voltage value as the voltage value of the primary transfer voltage during image forming (the target value), and holds that voltage value in the RAM 152. The CPU 150 sets the target value as the primary transfer voltage and executes constant voltage control during image forming.

In the first embodiment, the CPU 150 executes ATVC when not forming an image (in a preparatory step for image forming (a pre-rotation step)). The pre-rotation step is executed upon an instruction to start image forming being input to the image forming apparatus 1. In the pre-rotation step, the driving of the photosensitive drums 56*a* to 56*d*, the transfer transport belt 54, and the like is started. The ATVC is executed in the pre-rotation step, i.e., in a period leading up to the primary transfer of the toner image to the transfer transport belt 54. However, the ATVC can be executed at a time, when not forming an image, which is different from the pre-rotation step. In this manner, in the first embodiment, on the basis of the detection result from the current detecting circuit 201, the CPU 150 determines the voltage value to be supplied to the primary transfer members 59*a* to 59*d* from the primary transfer power source 200 during image forming.

Black Printing

Like color printing, ATVC is executed in black printing as well. In black printing, the transfer transport belt 54 and the primary transfer members 59*a*, 59*b*, and 59*c* are separated. The currents Itr1*a*, Itr1*b*, and Itr1*c* therefore do not flow, and only the current Itr1*d* flows. The CPU 150 sets ¼ the target value used in color printing as the target value for the total current used when performing the constant current control. Alternatively, the target value for the total current used when performing the constant current control in black printing may be determined on the basis of a past target value included in a black printing history.

Contact/Separation Detection Method for Transfer Transport Belt Color Printing

Figure 7:
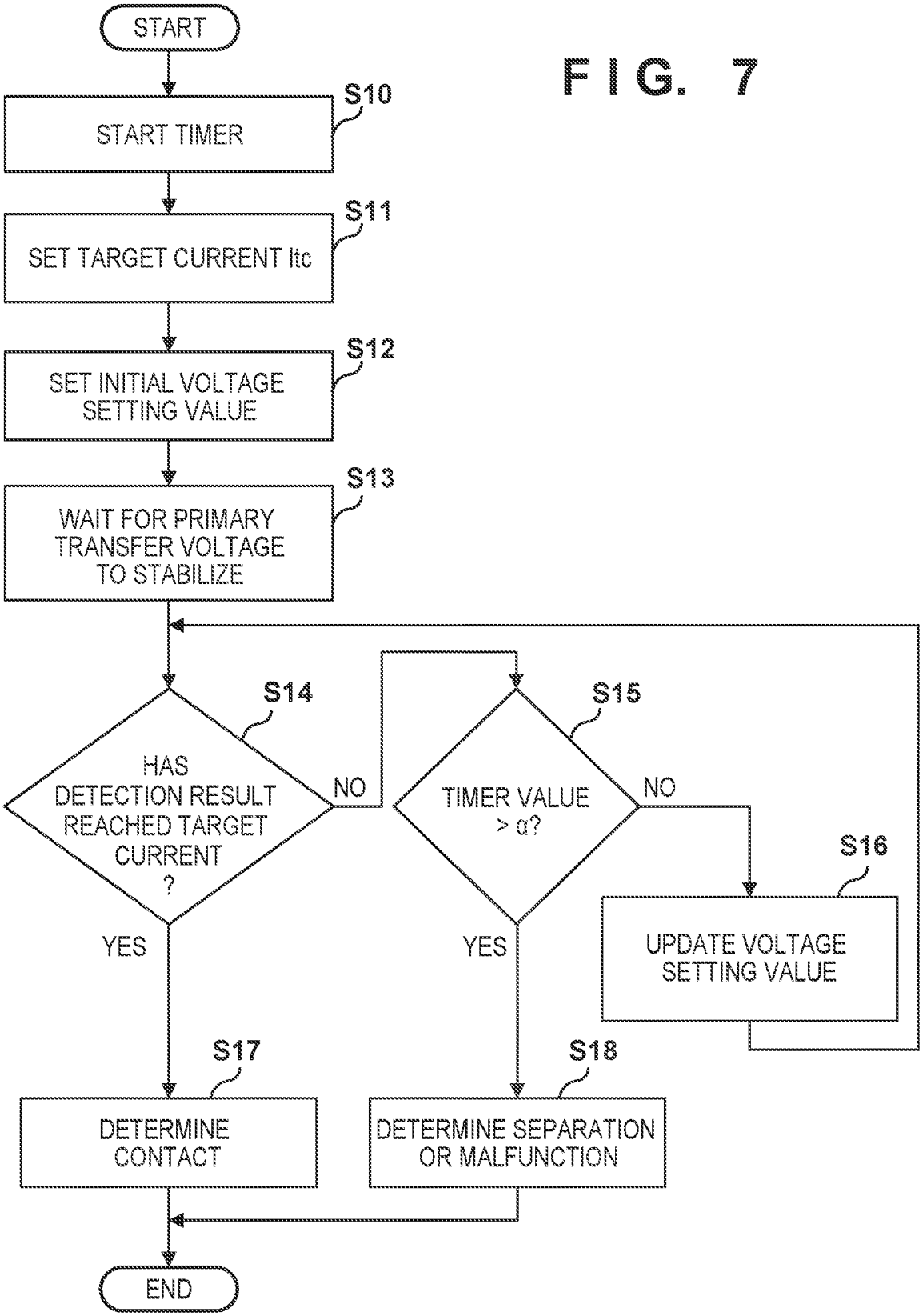
FIG. 7 is a flowchart illustrating contact/separation detection in color printing.

FIG. 7 illustrates a method for detecting the state of contact/state of separation, executed by the CPU 150 in color printing. Upon receiving a request to execute color printing, the CPU 150 starts ATVC by launching a control program stored in the ROM 151. In step S10, the CPU 150 starts the timer 153. The timer 153 measures the elapsed time starting at the timing at which ATVC is started.

In step S11, the CPU 150 sets a target current Itc in the primary transfer control unit 104. For example, the CPU 150 obtains, from the control table, the target current Itc that corresponds to a combination of a detection result of the environmental sensor 106 and a count value of the counter 154.

In step S12, the CPU 150 sets an initial voltage setting value of the primary transfer voltage in the primary transfer control unit 104. Through this, the primary transfer control unit 104 controls the primary transfer power source 200 and starts the output of the primary transfer voltage corresponding to the voltage setting value. The "initial voltage setting value" is a voltage setting value determined in ATVC executed when the image forming apparatus 1 is powered on or during the previous printing. The initial voltage setting value may be simply be called an "initial value". As the initial value, the CPU 150 may determine the voltage setting value corresponding to a combination of the detection result of the environmental sensor 106 and the count value of the counter 154. The ROM 151 may store a control table holding voltage setting values corresponding to environmental conditions and count values. However, instead of using a control table, a function (equation) that takes environmental conditions and a count value as inputs and outputs a voltage setting value may be used.

In step S13, the CPU 150 waits for the primary transfer voltage, which has been started at the initial value, to stabilize. In step S14, the CPU 150 determines whether or not Itr1, which is the result of detecting the primary transfer current, has reached the target current Itc. Itr1 is the total current, but will be called a "detected current" hereinafter. The determination method will be described in detail later. If the detected current Itr1 has not reached the target current Itc, the CPU 150 moves the sequence to step S15.

In step S15, the CPU 150 determines whether or not a timer value of the timer 153 has exceeded a determination time α. The determination time α will be described in detail later. If the timer value has not exceeded the determination time α, the CPU 150 moves the sequence to step S16. In step S16, the CPU 150 updates the voltage setting value of the primary transfer voltage so that the detected current Itr1 approaches the target current Itc. The CPU 150 then moves the sequence to step S14 again. In the first embodiment, if the detected current Itr1 has not reached the target current Itc, the voltage setting value is increased, with a predetermined fixed value set as an upper limit. Alternatively, PID control or the like may be used to update the voltage setting value. If in step S14 the detected current Itr1 has reached the target current Itc, the CPU 150 moves the sequence to step S17. In step S17, the CPU 150 determines that the primary transfer members 59*a*, 59*b*, 59*c*, and 59*d* are in contact with the transfer transport belt 54.

If in step S15 the timer value has exceeded the determination time α, the CPU 150 moves the sequence to step S18. In step S18, the CPU 150 determines that the primary transfer members 59*a*, 59*b*, and 59*c* are separated from the transfer transport belt 54, or that the contact/separation unit 77 has malfunctioned.

As described thus far, the CPU 150 can detect the state of contact/state of separation of the transfer transport belt 54 using ATVC for color printing. There are cases where, in step S18, it is determined that the primary transfer members 59*a*, 59*b*, and 59*c* are separated from the transfer transport belt 54, or that the contact/separation unit 77 has malfunctioned. If the image forming is continued in such a case, only black will be printed on the sheet, despite the user having instructed color printing. As such, the CPU 150 may suspend the image forming operations and display a message notifying the user of the malfunction in the operation unit 160.

Figure 9A:
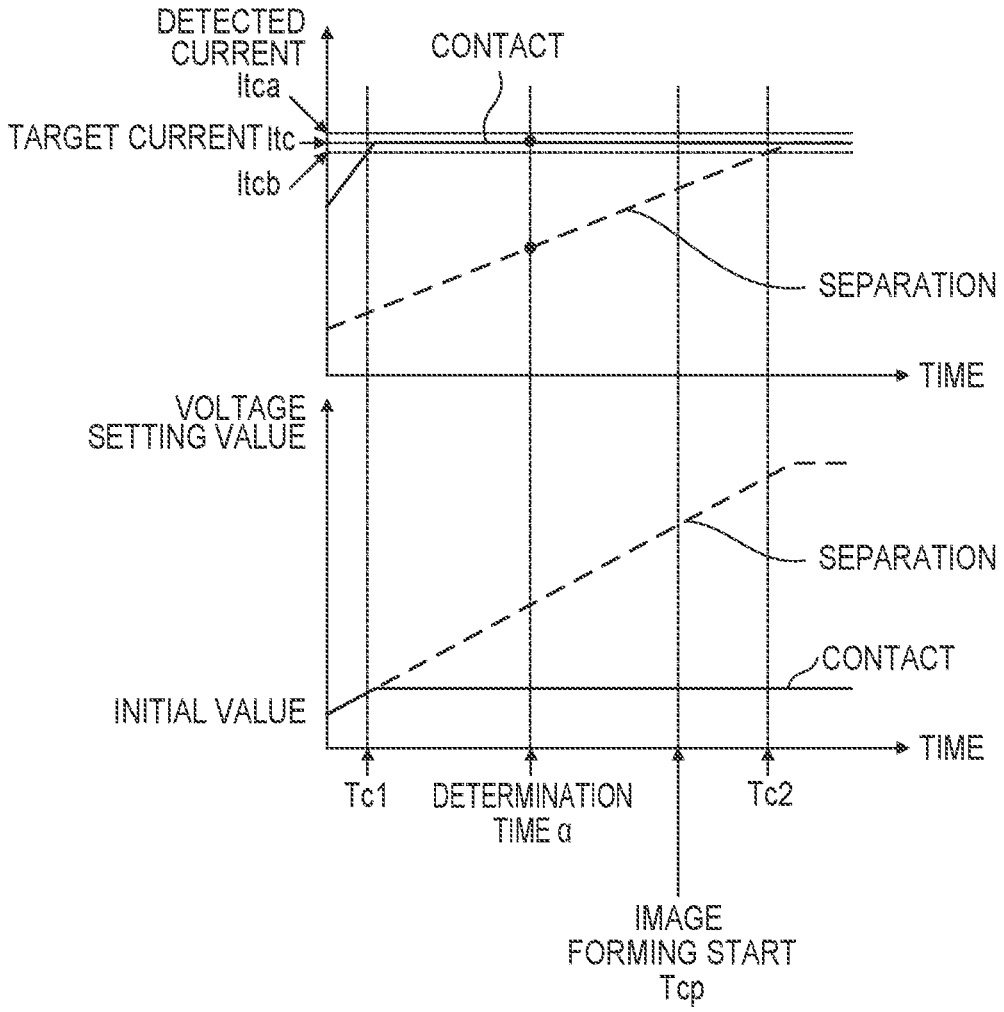
FIGS. 9A and 9B are diagrams illustrating detected current and voltage setting values.

FIG. 9A is a graph illustrating Itr1, which is the result of detecting the primary transfer current, and the voltage setting value for the primary transfer voltage. The vertical axis represents the detected current and the voltage setting value. The horizontal axis represents time. The solid line represents a value obtained when all of the primary transfer members 59*a*, 59*b*, 59*c*, and 59*d* are in the state of contact. The broken line represents a value obtained when the primary transfer members 59*a*, 59*b*, and 59*c* are in the state of separation.

In the state of contact, a primary transfer voltage based on the initial voltage setting value determined in the previous ATVC is applied to the primary transfer member 59. As such, the detected current Itr1 reaches the target current Itc quickly. Here, the CPU 150 determines that the detected current Itr1 has reached the target current Itc when the detected current Itr1 is within a predetermined range. The predetermined range is, for example, determined from an amplitude of the detected current Itr1 when the constant current control is being executed. For example, the target current in the state of contact is assumed to be 40 μA. In this case, the detection accuracy of the detected current Itr1 is 40 μA±8 μA. Accordingly, when the constant current control is executed, a control gain, a loop response, and the like are determined so that the detected current Itr1 falls within an amplitude of 40 μA±2 μA. When the amplitude is given a margin, the predetermined range is determined to be 40 μA±4 μA. Thus as illustrated in FIG. 9A, an upper limit value Itca of the predetermined range is 40 μA+4 μA, and a lower limit value Itcb of the predetermined range is 40 μA-4 μA.

On the other hand, in the state of separation, the primary transfer current at the point in time when the primary transfer voltage has started at the initial voltage setting value is no more than ¼ the primary transfer current in the state of contact. Focusing on load resistance as seen from the primary transfer power source 200, this is because the load resistance in the state of separation is four times the load resistance in the state of contact. In this manner, there is a large discrepancy between the target current Itc and the detected current in the state of separation, and it therefore takes a long time for the detected current to reach the target current Itc. In FIG. 9A, the detected current reaches the target current Itc at time Tc2. The determination time α is set to be between time Tc1 and time Tc2. Time Tc1 is the time when the detected current reaches the target current Itc in the state of contact. Note that the determination time α is stored in the ROM 151. The determination time α may be determined dynamically, taking into account fluctuations in the resistance value of the primary transfer section, which depend on changes in the environment, durability, and the like. Normally, color printing is performed only after the detected current reaches the target current and the detected current has stabilized sufficiently. Therefore, the determination time a may be set to a time between the time Tc1 and a time Tcp when image formation starts. Alternatively, the determination time α may coincide with the time Tcp. In these cases, the state of contact/state of separation of the transfer transport belt 54 can be determined without increasing the time taken to start printing.

Black Printing

Figure 8:
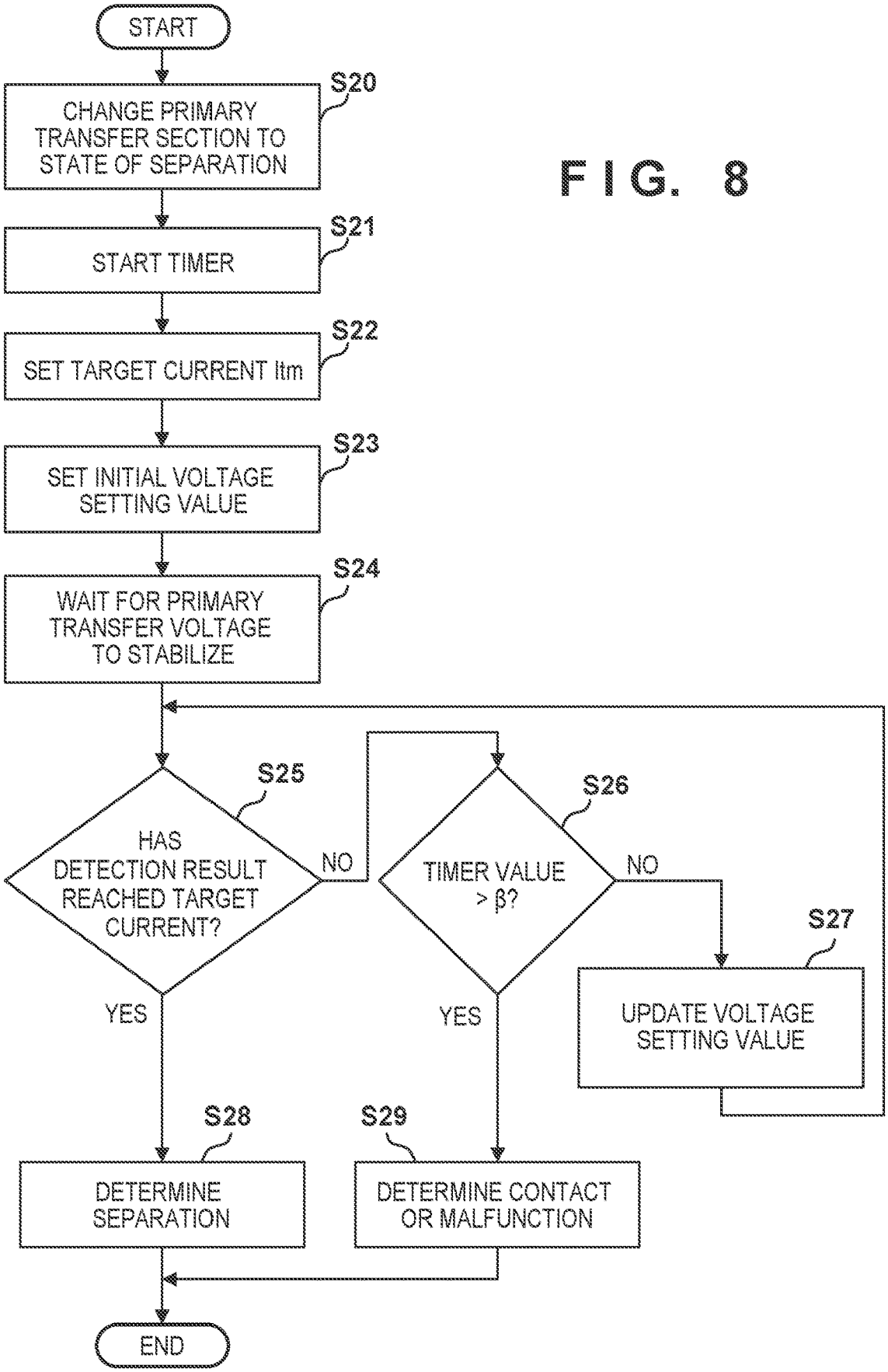
FIG. 8 is a flowchart illustrating contact/separation detection in black printing.

FIG. 8 is a diagram illustrating a method for detecting the state of contact/state of separation in black printing. When black printing is instructed, the CPU 150 sets the primary transfer members 59*a*, 59*b*, and 59*c* to the state of separation by controlling the contact/separation unit 77. When the black printing is complete, the CPU 150 sets the primary transfer members 59*a*, 59*b*, and 59*c* to the state of contact by controlling the contact/separation unit 77. In this manner, the primary transfer members 59*a*, 59*b*, and 59*c* are kept in the state of contact by default.

In step S20, the CPU 150 changes the primary transfer section from the state of contact to the state of separation by controlling the contact/separation unit 77. In step S21, the CPU 150 starts the timer 153. In step S22, the CPU 150 sets a target current Itm in the primary transfer control unit 104. The target current Itm is ¼ the target current Itc. In step S23, the CPU 150 sets the initial voltage setting value in the primary transfer control unit 104 as a setting value for the primary transfer voltage. The initial voltage setting value is a setting value determined through ATVC executed when the power is turned on or in the previous instance of printing. The primary transfer control unit 104 controls the primary transfer power source 200 and starts the output of the primary transfer voltage corresponding to the initial voltage setting value. In step S24, the CPU 150 waits until the primary transfer voltage stabilizes.

In step S25, the CPU 150 determines whether or not the detected current Itr1, which is the result of detecting the primary transfer current, has reached the target current Itm. A method for determining whether or not the detected current Itr1 has reached the target current Itm will be described later with reference to FIG. 9B. If the detected current Itr1 has not reached the target current Itm, the CPU 150 moves the sequence to step S26. In step S26, the CPU 150 determines whether or not a timer value of the timer 153 has exceeded a determination time β. The determination time β will be described in detail later with reference to FIG. 9B. If the timer value has not exceeded the determination time β, the CPU 150 moves the sequence to step S27. In step S27, the CPU 150 updates the setting value of the primary transfer voltage so that the detected current Itr1 approaches the target current Itm. The CPU 150 then moves the sequence to step S25 again. If the detected current Itr1 has not reached the target current Itm, the voltage setting value is updated, with a predetermined fixed value set as an upper limit.

If in step S25 the detected current Itr1 has reached the target current Itm, the CPU 150 moves the sequence to step S28. In step S28, the CPU 150 determines that the primary transfer members 59*a*, 59*b*, and 59*c* are separated from the transfer transport belt 54. If in step S26 the timer value has exceeded the determination time β, the CPU 150 moves the sequence to step S29. In step S29, the CPU 150 determines that the primary transfer members 59*a*, 59*b*, 59*c*, and 59*d* are in contact with the transfer transport belt 54, or that the contact/separation unit 77 has malfunctioned.

As described thus far, the state of contact/state of separation of the transfer transport belt 54 can be detected by using ATVC in black printing. There are cases where, in step S29, it is determined that the primary transfer members 59*a*, 59*b*, and 59*c* are in contact with the transfer transport belt 54, or that the contact/separation unit 77 has malfunctioned. In such cases, the CPU 150 may suspend the image forming operations and notify the user of the malfunction. Alternatively, rather than suspending the image forming operations, the CPU 150 may execute the black printing while maintaining the state of contact. The CPU 150 may also notify the user of the malfunction despite continuing the black printing.

Figure 9B:
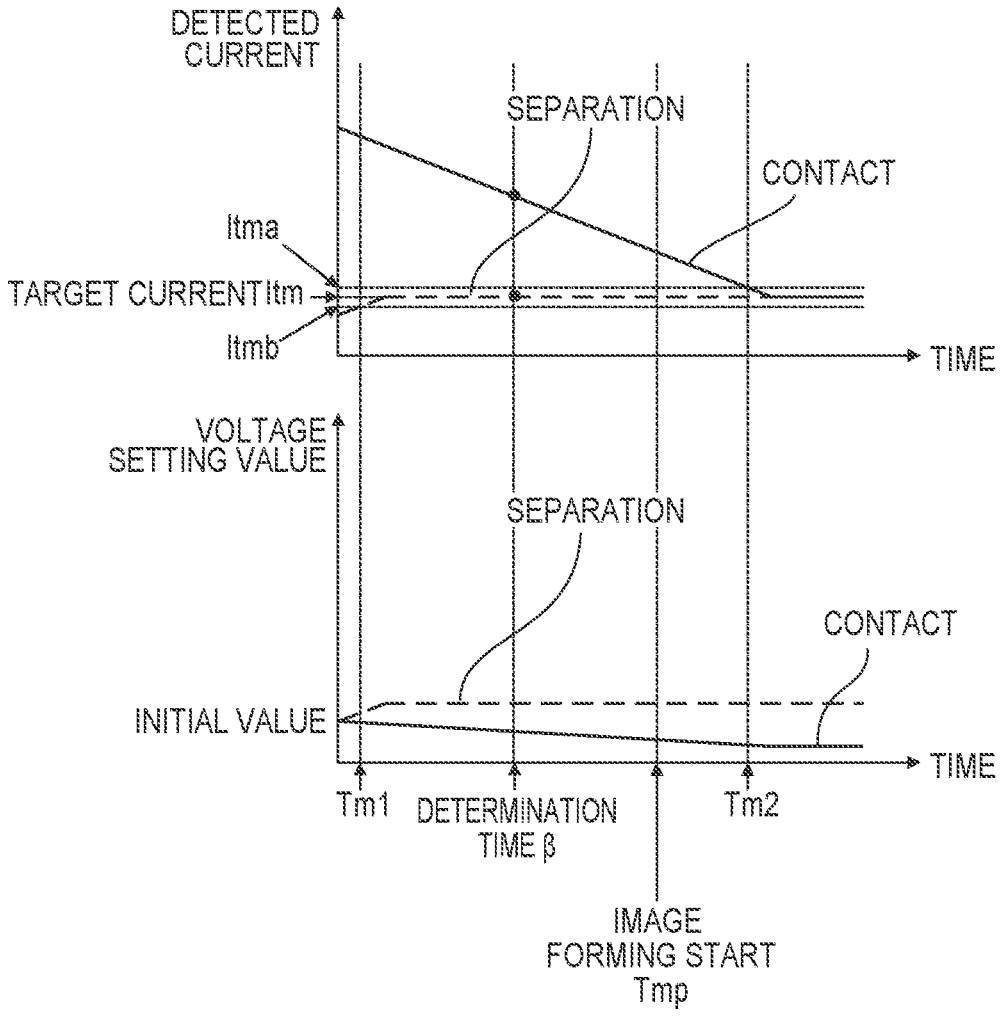

FIG. 9B is a graph illustrating Itr1, which is the result of detecting the primary transfer current, and the voltage setting value for the primary transfer voltage. The vertical axis represents the detected current and the voltage setting value. The horizontal axis represents time. The solid line represents a value obtained when all of the primary transfer members 59*a*, 59*b*, 59*c*, and 59*d* are in the state of contact. The broken line represents a value obtained when the primary transfer members 59*a*, 59*b*, and 59*c* are in the state of separation.

In black printing, a position change from the state of contact to the state of separation is carried out. Furthermore, the target current Itm is set to ¼ the target current Itc. A load resistance value when the primary transfer members 59*a*, 59*b*, and 59*c* are in the state of separation is four times the load resistance value during the state of contact. Accordingly, in the state of separation, the detected current Itr1 reaches the target current Itm quickly at time Tm1. Here, a predetermined range (threshold range) within which the detected current Itr1 is determined to have reached the target current Itm is determined from the amplitude of the detected current Itr1 when the constant current control is being executed. For example, when the target current Itm is 10 μA, the accuracy of the detected current Itr1 is 10 μA±2 μA. In the constant current control, a control gain, a loop response, and the like are determined so that the detected current Itr1 falls within an amplitude of 10 μA±0.5 μA. By giving the amplitude a margin, the predetermined range becomes 10 μA±1 μA. As illustrated in FIG. 9B, an upper limit value Itma of the predetermined range is 10 μA+1 μA, and a lower limit value Itmb of the predetermined range is 10 μA-1 μA.

On the other hand, in the state of contact, an excessive current of approximately four times that arising in the state of separation flows at the point in time when the primary transfer voltage has started from the initial voltage setting value. This is because the load resistance value seen from the primary transfer power source 200 is ¼ the load resistance value in the state of separation.

In this manner, there is a large discrepancy between the target current Itm and the detected current Itr1 in the state of contact. It therefore takes a long time for the detected current Itr1 to reach the target current Itm. The detected current Itr1 ultimately reaches the target current Itm at time Tm2. It is necessary to set the determination time β to be between time Tm1 and time Tm2. The determination time β is stored in the ROM 151. The CPU 150 may determine the determination time β taking into account fluctuations in the resistance value of the primary transfer section caused by changes in the environment, durability, and the like. The black printing is executed after the detected current Itr1 has reached the target current Itm in the state of separation and the detected current Itr1 has stabilized sufficiently. The determination time β may be set to a time between time Tm1 and time Tmp, or the determination time β may be set to Tmp. In this case, the state of contact/state of separation can be determined without increasing the wait time required before the start of printing.

In the first embodiment, the state of contact/state of separation is determined in parallel with ATVC. In particular, the state of contact/state of separation are determined accurately on the basis of the time required for the primary transfer current to reach the target current. Because the state of contact/state of separation are determined in parallel with ATVC, it is less likely that the wait time required before the start of printing will increase.

The first embodiment describes an example of a method for determining the state of contact/state of separation in color printing (a full-color mode) and black printing (a monochromatic mode). However, the present invention can also be applied in a two-color mode that uses yellow and magenta, a two-color mode that uses magenta and cyan, a three-color mode that uses yellow, magenta, and cyan, and the like. This is because the contact/separation unit 77 can move the primary transfer members 59*a*, 59*b*, 59*c*, and 59*d* independently. The present invention can be applied even in such an image forming apparatus that has three or more printing modes. In other words, the state of contact/state of separation can be determined by determining whether or not the detected current has reached the target current at the timing at which the determination time has passed.

In the first embodiment, the one primary transfer power source 200 supplies a common primary transfer voltage Vtr1 to the four primary transfer members 59. However, four independent primary transfer power sources 200 may be provided for corresponding ones of the four primary transfer members 59.

The first embodiment focuses on whether or not the detected current has reached the target current at the timing at which the determination time has passed. However, the CPU 150 may compare an amount of change (slope) in the primary transfer current per unit of time with a threshold. In color printing, the CPU 150 obtains the slope of the primary transfer current in a period from the start of ATVC to time Tc1. In black printing, the CPU 150 obtains the slope of the primary transfer current in a period from the start of ATVC to time Tm1. The CPU 150 compares an absolute value of a slope θ with a slope threshold γ. The slope threshold γ is set to a value between the slope during the state of contact and the slope during the state of separation (e.g., an average value). The CPU 150 may determine the threshold γ taking into account fluctuations in the resistance value of the primary transfer section, which depend on changes in the environment, durability, and the like.

Second Embodiment

In the first embodiment, the state of contact/state of separation are determined on the basis of the time required for the detected current to reach the target current. In a second embodiment, the state of contact/state of separation are determined on the basis of whether or not the detected current exceeds a threshold at a given timing.

Method of Detecting State of Contact/State of Separation Color Printing

Figure 10:
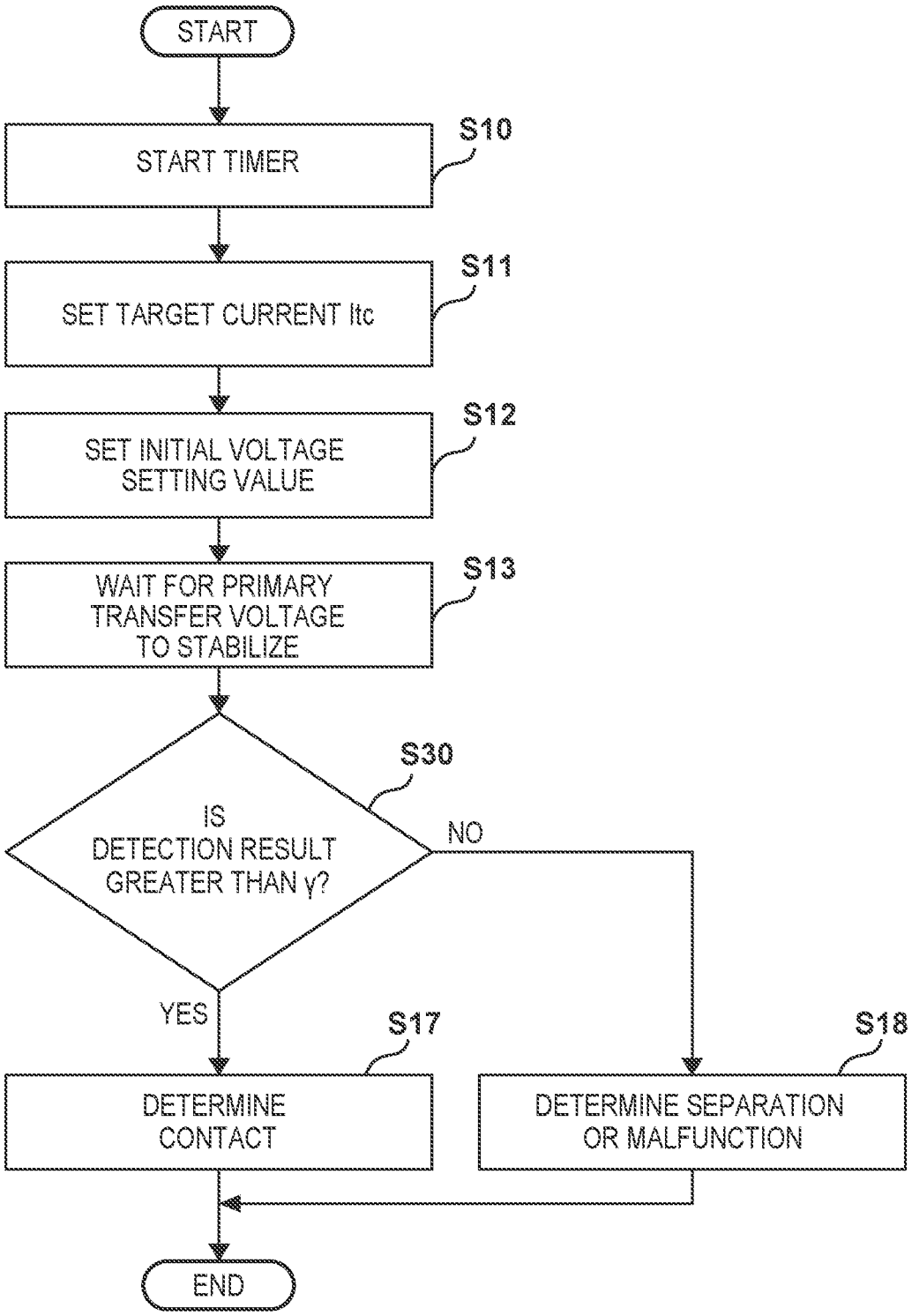
FIG. 10 is a diagram illustrating a path of primary transfer current in color printing.

FIG. 10 is a diagram illustrating a method for detecting the state of contact/state of separation in color printing. Note that in the second embodiment, matters that are the same as in the first embodiment will be given the same reference signs, and will not be described.

As illustrated in FIG. 10, the CPU 150 executes steps S10 to S13, and then moves to step S30. In step S30, the CPU 150 determines whether or not the result of detecting the primary transfer current (the detected current Itr1) is greater than a current threshold γ. The current threshold γ will be described in detail later with reference to FIG. 12A. If the detected current Itr1 is greater than the current threshold γ, the CPU 150 moves the sequence to step S17. In other words, the CPU 150 determines that the primary transfer members 59*a*, 59*b*, 59*c*, and 59*d* are in contact with the transfer transport belt 54. On the other hand, if in step S30 the detected current Itr1 is not greater than the current threshold γ, the CPU 150 moves the sequence to step S18. In other words, the CPU 150 determines that the primary transfer members 59*a*, 59*b*, and 59*c* are separated from the transfer transport belt 54, or that the contact/separation unit 77 has malfunctioned. In this manner, in the second embodiment, the state of contact and the state of separation can be detected by comparing the detected current Itr1 and the current threshold γ.

Figure 12A:
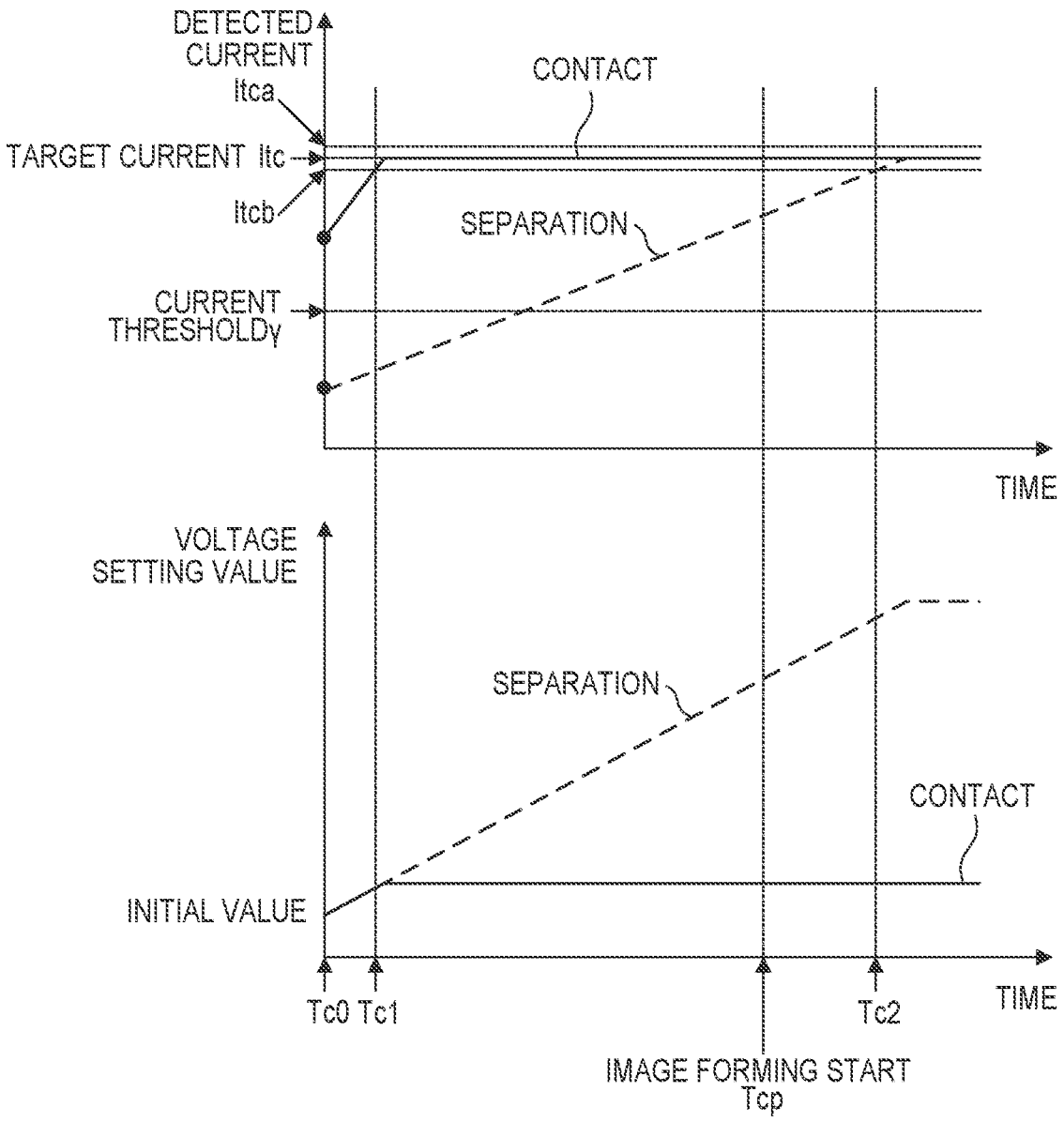
FIGS. 12A and 12B are diagrams illustrating detected current and voltage setting values.

FIG. 12A illustrates the detected current and the voltage setting value. The vertical axis represents the detected current or the voltage setting value. The horizontal axis represents time. The solid line represents changes in the detected current and the voltage setting value in the state of contact. The broken line represents changes in the detected current and the voltage setting value in the state of separation. The changes in the detected current and the voltage setting value indicated in FIG. 12A are the same as the changes in the detected current and the voltage setting value illustrated in FIG. 9A.

In the second embodiment, the detected current obtained after the primary transfer voltage based on the initial value of the voltage setting value in ATVC has been started is compared with the current threshold. In this example, the detected current Itr1 is obtained at time Tc0. In other words, the primary transfer voltage based on the initial value of the voltage setting value stabilizes at time Tc0. To accurately detect the state of contact/state of separation on the basis of the detected current obtained after the primary transfer voltage corresponding to the initial value has been applied, it is necessary for the initial value to be determined accurately with respect to the target current Itc. The load resistance value fluctuates greatly depending on environmental conditions, durability conditions, and so on. Accordingly, the detected current may not be constant even when the same initial value is set. With the second embodiment, the state of contact and the state of separation can be determined accurately on the basis of the detected current when ATVC is executed a second time under the conditions under which ATVC was executed the first time. In other words, the second embodiment is useful when the same photosensitive drum is used continuously at the same temperature and humidity.

On the other hand, the load resistance value in the state of separation is four times the load resistance value in the state of contact. In other words, the detected current in the state of separation is ¼ the detected current in the state of contact. The current threshold γ is set to a value between the primary transfer current arising after the primary transfer voltage corresponding to the initial value in the state of contact is applied and the primary transfer current arising after the primary transfer voltage corresponding to the initial value in the state of separation is applied. The current threshold γ is stored in the ROM 151. The current threshold γ may be determined taking into account fluctuations in the resistance value of the primary transfer section caused by changes in the environment, durability, and the like. The CPU 150 determines that the primary transfer section is in the state of contact when the detected current is greater than the current threshold γ. The CPU 150 determines that the primary transfer section is in the state of separation, or that the contact/separation unit 77 has malfunctioned, when the detected current is not greater than the current threshold γ.

In the second embodiment, the CPU 150 can determine the state of contact/state of separation without waiting for the determination time α described in the first embodiment. There are situations where the CPU 150 starts up a heater of the fixer 62, starts motors, and so on in parallel with ATVC. The CPU 150 can therefore stop the image forming operations more quickly when it has been determined that the primary transfer section is in the state of separation or the contact/separation unit 77 has malfunctioned. This makes it possible to reduce power consumption.

Black Printing

Figure 11:
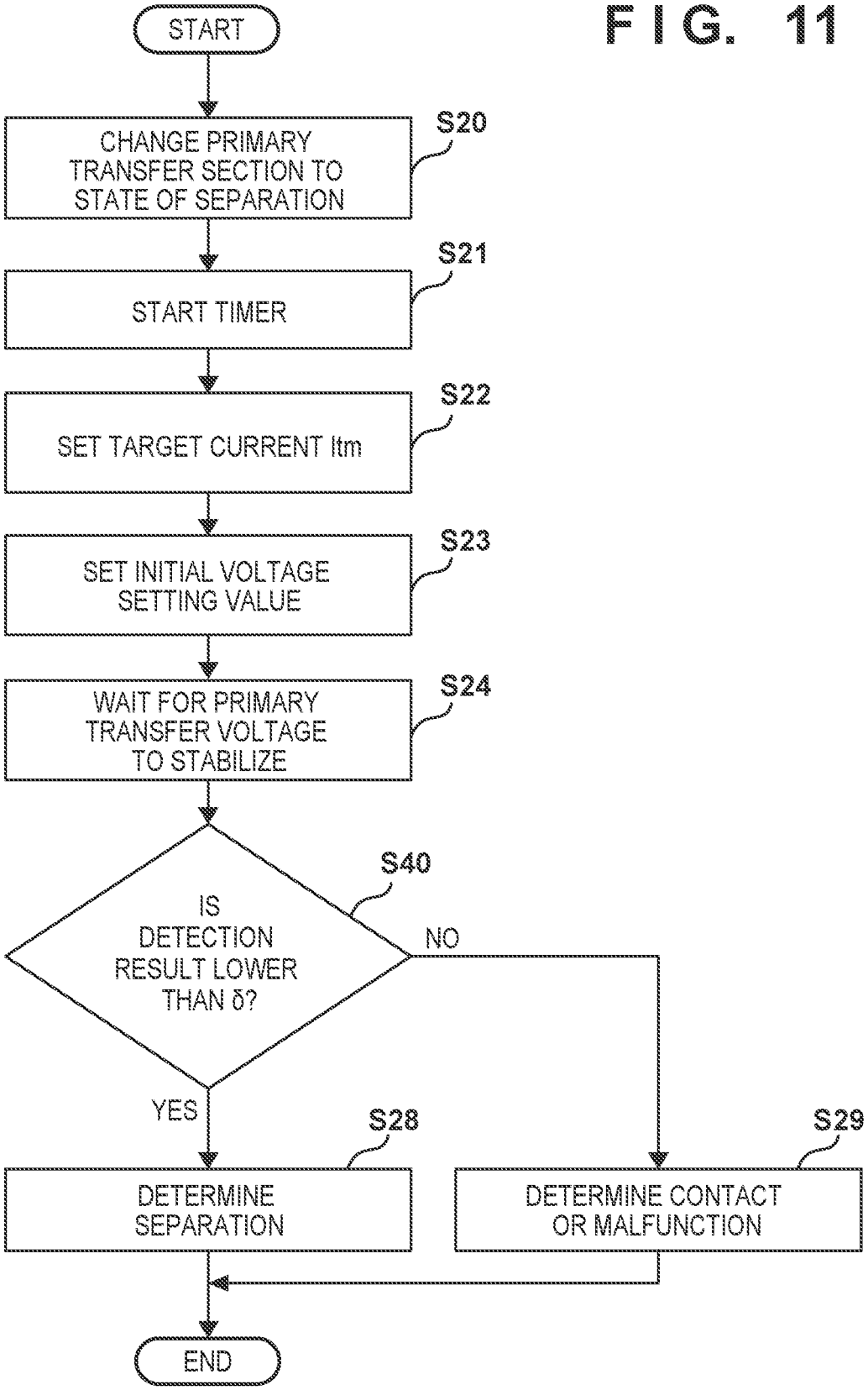
FIG. 11 is a diagram illustrating a path of primary transfer current in black printing.

FIG. 11 is a diagram illustrating a method for detecting the state of contact/state of separation in black printing. Note that in the second embodiment, matters that are the same as in the first embodiment will be given the same reference signs, and will not be described.

As illustrated in FIG. 11, the CPU 150 executes steps S20 to S24, and then moves to step S40. In step S40, the CPU 150 determines whether or not the detected current Itr1 corresponding to the initial voltage setting value is greater than a current threshold S. The current threshold δ will be described in detail later with reference to FIG. 12B. When the detected current is lower than the current threshold δ, the CPU 150 moves the sequence to step S28. In step S28, the CPU 150 determines that the primary transfer members 59*a*, 59*b*, and 59*c* are separated from the transfer transport belt 54. When in step S40 the detected current Itr1 is not lower than the current threshold δ, the CPU 150 moves the sequence to step S29. In step S29, the CPU 150 determines that the primary transfer members 59*a*, 59*b*, 59*c*, and 59*d* are in contact with the transfer transport belt 54, or that the contact/separation unit 77 has malfunctioned. In this manner, the state of contact/state of separation can be determined using ATVC in black printing.

Figure 12B:
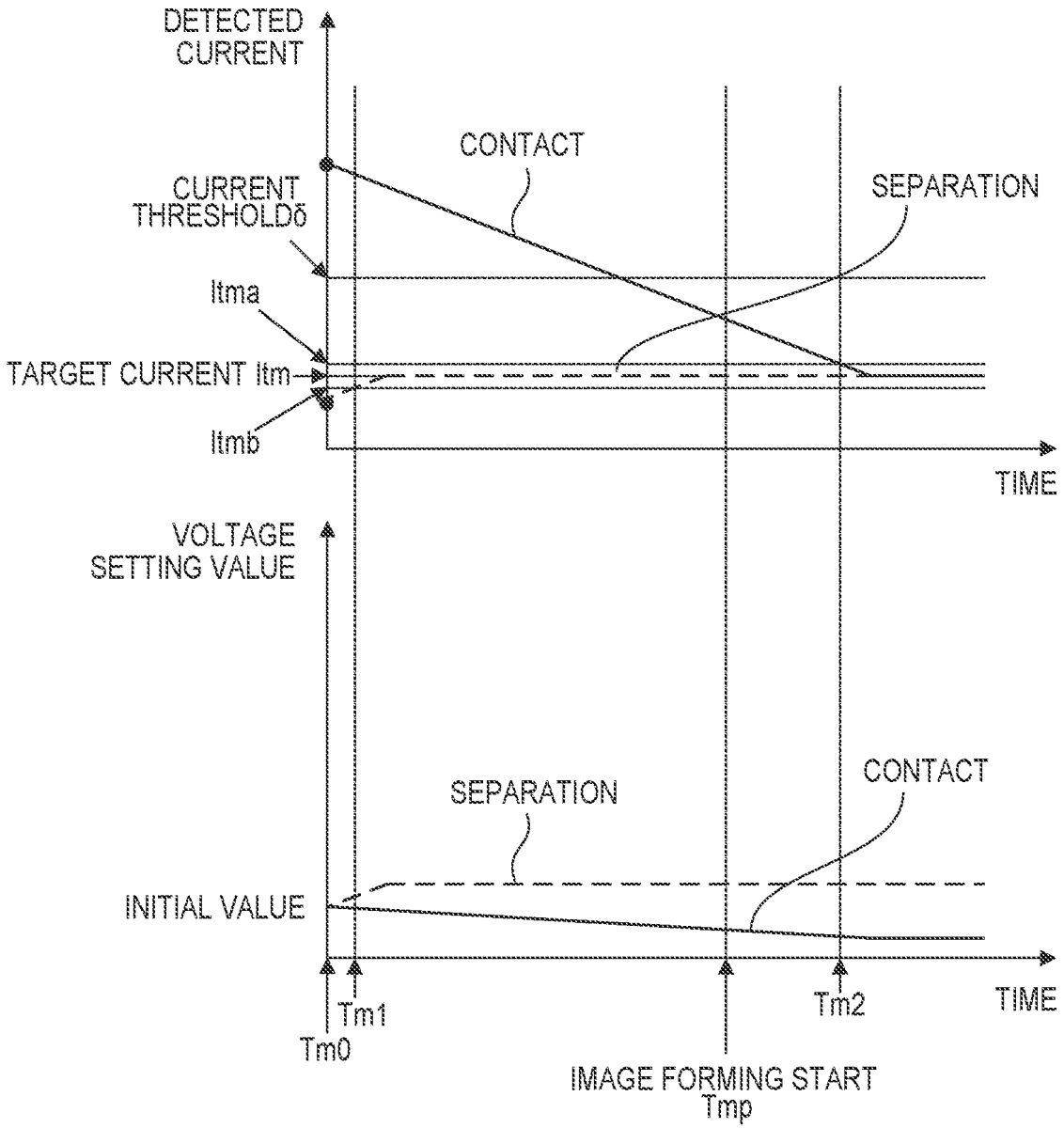

FIG. 12B illustrates the detected current and the voltage setting value. The vertical axis represents the detected current or the voltage setting value. The horizontal axis represents time. The solid line represents changes in the detected current and the voltage setting value in the state of contact. The broken line represents changes in the detected current and the voltage setting value in the state of separation. The changes in the detected current and the voltage setting value indicated in FIG. 12B are the same as the changes in the detected current and the voltage setting value illustrated in FIG. 9B.

In the second embodiment, the detected current obtained when the primary transfer voltage corresponding to the initial voltage setting value in ATVC is compared with the current threshold. The state of contact/state of separation of the primary transfer section is then determined on the basis of the result of the comparison. Note that in FIG. 12B, the detected current Itr1 is obtained at time Tm0. In other words, the primary transfer voltage based on the initial value of the voltage setting value stabilizes at time Tm0.

As described in the section of the second embodiment concerning color printing, the initial voltage setting value determined in the previous instance of ATVC is used. With the second embodiment, the state of contact and the state of separation can be distinguished accurately when ATVC is executed a second time under the conditions under which ATVC was executed the first time. The load resistance value in the state of contact is ¼ the load resistance value in the state of separation. The primary transfer current in the state of contact is four times the primary transfer current in the state of separation. The current threshold δ is set to a value between the primary transfer current in the state of contact and the primary transfer current in the state of separation. The current threshold δ is stored in the ROM 151. The current threshold δ may be determined taking into account fluctuations in the load resistance value of the primary transfer section caused by changes in the environment, durability, and the like.

In the second embodiment, the state of contact/state of separation can be determined without waiting for the determination time β described in the first embodiment. The CPU 150 can therefore stop the image forming operations more quickly when it has been determined that the primary transfer section is in the state of contact or the contact/separation unit 77 has malfunctioned. This makes it possible to reduce power consumption.

Technical Spirit Derived from Embodiments

[Perspective 1]

The photosensitive drum 56*d* is an example of a first image bearing member that carries a toner image of a first color (e.g., black). The photosensitive drums 56*a*, 56*b*, and 56*c* are examples of a second image bearing member that carries a toner image of a second color (e.g., yellow, magenta, or cyan). The transfer transport belt 54 is an example of an intermediate transfer belt. The primary transfer member 59*d* functions as a first transfer member that transfers the toner image of the first color from the first image bearing member toward the intermediate transfer belt in a state of contact, the state of contact being a state in which the first transfer member contacts an inner circumferential surface of the intermediate transfer belt and causes an outer circumferential surface of the intermediate transfer belt to contact the first image bearing member. The primary transfer members 59*a*, 59*b*, and 59*c* function as a second transfer member that transfers the toner image of the second color from the second image bearing member toward the intermediate transfer belt in a state of contact, the state of contact being a state in which the second transfer member contacts the inner circumferential surface of the intermediate transfer belt and causes the outer circumferential surface of the intermediate transfer belt to contact the second image bearing member. The contact/separation unit 77 switches between a state of separation and a state of contact, the state of separation being a state in which the second image bearing member is separated from the outer circumferential surface of the intermediate transfer belt by moving the second transfer member, and the state of contact being a state in which the second image bearing member is caused to contact the outer circumferential surface of the intermediate transfer belt by moving the second transfer member. The primary transfer power source 200 is an example of a transfer power source that outputs a transfer voltage to the first transfer member and the second transfer member. The current detecting circuit 201 functions as a detection circuit capable of detecting a current flowing in the first transfer member and a current flowing in the second transfer member when the transfer voltage is applied to the first transfer member and the second transfer member. The CPU 150 and the primary transfer control unit 104 are an example of an adjustment circuit (a control circuit) that executes voltage adjustment processing (e.g., ATVC) of adjusting a transfer voltage so that the current detected by the detection circuit becomes a predetermined current value (e.g., a target current). The CPU 150 and the primary transfer control unit 104 execute the voltage adjustment processing before the toner image is transferred from at least one of the first image bearing member and the second image bearing member to the intermediate transfer belt. The CPU 150 functions as a determination circuit (a processor circuit) that determines whether the second transfer member is in the state of contact or is in the state of separation on the basis of behavior of the current detected in a period in which the adjustment circuit is executing the voltage adjustment processing. Here, it is determined whether the behavior is behavior unique to when the second transfer member is in the state of contact, or is behavior unique to when the second transfer member is in the state of separation. Through this, contact/separation determination can be made without creating both states in which the photosensitive drum and the primary transfer member are in the state of contact and the state of separation.

[Perspective 2]

The current detecting circuit 201 may be configured to detect a total current (e.g., Itr1), the total current being a total of the current flowing in the first transfer member and the current flowing in the second transfer member. This makes it possible to reduce the number of current detecting circuits 201.

[Perspective 3]

The CPU 150 may determine whether the second transfer member is in the state of contact or is in the state of separation relative to the second image bearing member on the basis of whether or not the current detected by the detection circuit at a predetermined timing has reached the target current. The predetermined timing may be, for example, the determination time $\alpha$ or $\beta$.

[Perspective 4]

The predetermined timing may be set to a timing between a timing at which the detected current reaches the target current when the second transfer member is actually in the state of contact and a timing at which the detected current reaches the target current when the second transfer member is actually in the state of separation.

[Perspective 5]

A color printing mode is an example of a first mode in which the toner images are transferred from the first image bearing member and the second image bearing member to the intermediate transfer belt when the first transfer member and the second transfer member are both in the state of contact. The above-described printing mode that uses two colors of toner and the printing mode that uses three colors of toner are also examples of the first mode. A black printing mode is an example of a second mode in which the toner image is transferred from the first image bearing member to the intermediate transfer belt when the first transfer member is in the state of contact and the second transfer member is in the state of separation. The primary transfer control unit 104 uses a first target current (e.g., Itc) as the target current in the first mode, and uses a second target current (e.g., Itm) as the target current in the second mode. The first target current (the first current value) is greater than the second target current (the second current value). In the voltage adjustment processing while in the first mode, the current detected at the predetermined timing may have reached the first target current. In this case, the CPU 150 determines that both the first transfer member and the second transfer member are in the state of contact. On the other hand, the current detected at the predetermined timing may not have reached the first target current. In this case, the CPU 150 determines that the second transfer member is in the state of separation.

In the voltage adjustment processing while in the second mode, the current detected at the predetermined timing may have reached the second target current. In this case, the CPU 150 determines that the second transfer member is in the state of separation. On the other hand, the current detected at the predetermined timing may not have reached the second target current. In this case, the CPU 150 determines that both the first transfer member and the second transfer member are in the state of contact.

[Perspective 6]

In the voltage adjustment processing in the first mode, the CPU 150 may determine that the contact/separation unit has malfunctioned when the current detected at the predetermined timing has not reached the first target current. In the voltage adjustment processing in the second mode, the CPU 150 may determine that the contact/separation unit has malfunctioned when the current detected at the predetermined timing has not reached the second target current. This makes it possible to perform maintenance, make repairs, and so on early.

[Perspective 7]

As described in the second embodiment, the CPU 150 may determine whether or not the current detected while the transfer voltage is set to an initial voltage by the primary transfer control unit 104 exceeds a predetermined current threshold. The CPU 150 may determine whether the second transfer member is in the state of contact or the state of separation relative to the second image bearing member on the basis of a result of this determination.

[Perspective 8]

The predetermined current threshold is set to a value between two currents (e.g., an average value). One of the currents is, for example, the current detected when the second transfer member is actually in the state of contact and the initial voltage is set. The other current is, for example, the current detected when the second transfer member is actually in the state of separation and the initial voltage is set. These two currents are currents detected in a normal state of contact and a normal state of separation. As such, an accurate contact/separation determination can be realized by determining the current threshold in light of these currents.

[Perspective 9]

In the voltage adjustment processing while in the first mode, there is a first period in which the transfer voltage is set to the initial voltage. When the current detected in the first period exceeds the first current threshold, both the first transfer member and the second transfer member may be determined to be in the state of contact. When the current does not exceed the first current threshold, the second transfer member may be determined to be in the state of separation.

In the voltage adjustment processing while in the second mode, there is a second period in which the transfer voltage is set to the initial voltage. When the current detected in the second period exceeds the second current threshold, both the first transfer member and the second transfer member may be determined to be in the state of contact. When the current does not exceed the second current threshold, the second transfer member may be determined to be in the state of separation.

[Perspective 10]

When the current detected in the first period does not exceed the first current threshold, the contact/separation unit may be determined to have malfunctioned. When the current detected in the second period exceeds the second current threshold, the contact/separation unit may be determined to have malfunctioned.

[Perspective 11]

The CPU 150 may determine the state of contact and the state of separation on the basis of whether or not an amount of change per unit of time in the detected current exceeds a predetermined threshold. The amount of change per unit of time may be understood as the slope of the current. To find the amount of change, the CPU 150 may obtain at least two sampling values for the current.

[Perspective 12]

The predetermined threshold is set to a difference between an amount of change in the detected current when the second transfer member is actually in the state of contact and an amount of change in the detected current when the second transfer member is actually in the state of separation. This makes it possible to accurately distinguish between the state of contact and the state of separation.

[Perspective 13]

In the voltage adjustment processing while in the first mode, the amount of change may exceed a first threshold. In this case, the CPU 150 determines that both the first transfer member and the second transfer member are in the state of contact. The CPU 150 determines that the second transfer member is in the state of separation when the amount of change does not exceed the first threshold. Note that based on FIG. 9A, the first threshold can be set to a positive value.

In the voltage adjustment processing while in the second mode, the amount of change may not exceed a second threshold. In this case, the CPU 150 determines that both the first transfer member and the second transfer member are in the state of contact. The CPU 150 determines that the second transfer member is in the state of separation when the amount of change exceeds the second threshold. Note that based on FIG. 9B, the second threshold can be set to zero. This is because the slope of the current is a negative value in the state of contact, and the slope of the current is a positive value in the state of separation.

[Perspective 14]

In the voltage adjustment processing while in the first mode, the CPU 150 may determine that the contact/separation unit has malfunctioned when the amount of change does not exceed the first threshold. In the voltage adjustment processing while in the second mode, the amount of change may not exceed a second threshold. In this case, the CPU 150 may determine that the contact/separation unit has malfunctioned.

[Perspective 15]

In the voltage adjustment processing while in the first mode, when the second transfer member is in the state of separation, the CPU 150 may suspend image forming operations. This is because in such a case, only a black image will actually be printed on the sheet, despite the user expecting a color print.

[Perspective 16]

In the voltage adjustment processing while in the second mode, when the second transfer member is in the state of contact, the CPU 150 may suspend image forming operations. This suppresses wear and the like on the second transfer member.

[Perspective 17]

In the voltage adjustment processing while in the second mode, when the second transfer member is in the state of contact, the CPU 150 may continue image forming operations and make a notification that the contact/separation unit has malfunctioned. In this case, the user can obtain a black print, and thus no sheets will be wasted. Additionally, making a notification of the malfunction makes it possible to perform maintenance, make repairs, and so on the contact/separation unit early.

[Perspective 18]

The first transfer member may handle a black toner image. The second transfer member may include a transfer member that handles a yellow toner image, a transfer member that handles a cyan toner image, and a transfer member that handles a magenta toner image.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-039212, filed Mar. 6, 2020 which is hereby incorporated by reference herein in its entirety.

What is claimed is:

1. An image forming apparatus comprising:

a first image bearing member that carries a toner image of a first color;

a second image bearing member that carries a toner image of a second color;

an intermediate transfer belt onto which the toner image carried by at least one of the first image bearing member and the second image bearing member is transferred;

a first transfer member that transfers the toner image of the first color from the first image bearing member toward the intermediate transfer belt in a state of contact, the state of contact being a state in which the first transfer member contacts an inner circumferential surface of the intermediate transfer belt and causes an outer circumferential surface of the intermediate transfer belt to contact the first image bearing member;

a second transfer member that transfers the toner image of the second color from the second image bearing member toward the intermediate transfer belt in a state of contact, the state of contact being a state in which the second transfer member contacts the inner circumferential surface of the intermediate transfer belt and causes the outer circumferential surface of the intermediate transfer belt to contact the second image bearing member;

a contact/separation unit that switches between a state of separation and a state of contact, the state of separation being a state in which the second image bearing member is separated from the outer circumferential surface of the intermediate transfer belt by moving the second transfer member, and the state of contact being a state in which the second image bearing member is caused to contact the outer circumferential surface of the intermediate transfer belt by moving the second transfer member;

a transfer power source that outputs a transfer voltage to the first transfer member and the second transfer member;

a detection circuit capable of detecting a current flowing in the first transfer member and a current flowing in the second transfer member when the transfer voltage is applied to the first transfer member and the second transfer member;

a control circuit that is operable in:

a first mode in which the toner images are transferred from the first image bearing member and the second image bearing member to the intermediate transfer belt when the first transfer member and the second transfer member are both in the state of contact, and a second mode in which the toner image is transferred from the first image bearing member to the intermediate transfer belt when the first transfer member is in the state of contact and the second transfer member is in the state of separation, and the control circuit executes a voltage adjustment processing of adjusting a voltage output from the transfer power source so that the current detected by the detection circuit becomes a predetermined current value, the control circuit executing the voltage adjustment processing before the toner image is transferred in the first mode or the second mode; and a processor that determines whether the second transfer member is in the state of contact or is in the state of separation on the basis of whether or not the current detected by the detection circuit at a predetermined timing has reached the predetermined current value in a period in which the control circuit is executing the voltage adjustment processing, wherein the control circuit uses a first current value as the predetermined current value in the first mode, and uses a second current value as the predetermined current value in the second mode, in the voltage adjustment processing while in the first mode, the processor determines that both the first transfer member and the second transfer member are in the state of contact when the current detected by the detection circuit at the predetermined timing has reached the first current value, and determines that the second transfer member is in the state of separation when the current detected by the detection circuit at the predetermined timing has not reached the first current value, in the voltage adjustment processing while in the second mode, the processor determines that the second transfer member is in the state of separation when the current detected by the detection circuit at the predetermined timing has reached the second current value, and determines that both the first transfer member and the second transfer member are in the state of contact when the current detected by the detection circuit at the predetermined timing has not reached the second current value, and the first current value is greater than the second current value.

2. The image forming apparatus according to claim 1, wherein the detection circuit is configured to detect a total current, the total current being a total of the current flowing in the first transfer member and the current flowing in the second transfer member.

3. The image forming apparatus according to claim 1, wherein the predetermined timing is set to a timing between a timing at which the current detected by the detection circuit reaches the predetermined current value when the second transfer member is actually in the state of contact and a timing at which the current detected by the detection circuit reaches the predetermined current value when the second transfer member is actually in the state of separation.

4. The image forming apparatus according to claim 1, wherein in the voltage adjustment processing while in the first mode, the processor determines that the contact/separation unit has malfunctioned when the current detected by the detection circuit at the predetermined timing has not reached the first current value, and in the voltage adjustment processing while in the second mode, the processor determines that the contact/separation unit has malfunctioned when the current detected by the detection circuit at the predetermined timing has not reached the second current value.

5. The image forming apparatus according to claim 1, wherein when the processor determines, in the voltage adjustment processing while in the first mode, that the second transfer member is in the state of separation, the image forming apparatus suspends image forming operations.

6. The image forming apparatus according to claim 1, wherein when the processor determines, in the voltage adjustment processing while in the second mode, that the second transfer member is in the state of contact, the image forming apparatus suspends image forming operations.

7. The image forming apparatus according to claim 1, wherein when the processor determines, in the voltage adjustment processing while in the second mode, that the second transfer member is in the state of contact, the image forming apparatus continues image forming operations and makes a notification that the contact/separation unit has malfunctioned.

8. The image forming apparatus according to claim 1, wherein the first transfer member handles a black toner image, and the second transfer member comprises at least one of a transfer member that handles a yellow toner image, a transfer member that handles a cyan toner image, and a transfer member that handles a magenta toner image.

* * * * *